US006079238A

United States Patent [19]

Hoffmann et al.

[11] Patent Number: 6,079,238

[45] Date of Patent: Jun. 27, 2000

[54] DOOR MOUNTING

[75] Inventors: Otto Hoffmann, Mammendorf; Holger Schönewolf, Augsburg; Thorsten Warsow, Schloss Holte-Stukenbrock, all of Germany

[73] Assignee: Sesam Elektronische Sioherheitssysteme GmbH, Mammendorf, Germany

[21] Appl. No.: 09/208,945

[22] Filed: Dec. 9, 1998

[30] Foreign Application Priority Data

Dec. 10, 1997 [DE] Germany ..... 197 54 923

[51] Int. Cl.[7] ..... E05B 47/06

[52] U.S. Cl. ..... 70/283; 149/278.1; 149/279.1

[58] Field of Search ..... 70/149, 150, 277–279.1, 70/283

[56] References Cited

U.S. PATENT DOCUMENTS

| | | | |
|---|---|---|---|
| 3,677,043 | 7/1972 | Cox | 70/283 X |
| 3,933,016 | 1/1976 | Nolin | 70/149 |
| 4,148,092 | 4/1979 | Martin | 70/149 X |
| 4,429,556 | 2/1984 | Kambic | 70/149 |
| 4,770,012 | 9/1988 | Johansson et al. | 70/278.1 |
| 4,820,330 | 4/1989 | Lin | 70/277 |
| 4,979,383 | 12/1990 | Tully | 70/283 X |
| 4,995,248 | 2/1991 | Liu | 70/107 |
| 5,060,991 | 10/1991 | Davidian et al. | 70/149 X |
| 5,437,174 | 8/1995 | Aydin | 70/150 X |
| 5,475,996 | 12/1995 | Chen | 70/279.1 |
| 5,487,289 | 1/1996 | Otto, III et al. | 70/283 X |
| 5,513,510 | 5/1996 | Solvieff et al. | 70/149 X |
| 5,715,715 | 2/1998 | Nunez | 70/283 |
| 5,841,347 | 11/1998 | Kim | 70/278.1 X |

*Primary Examiner*—Suzanne Dino Barrett
*Attorney, Agent, or Firm*—Horst M. Kasper

[57] ABSTRACT

A door mounting for a closure mechanism of a door (2), wherein the door mounting exhibits a locking means (11), which locking means (11) blocks a locking mechanism (29, 36) in a locking position, wherein the locking mechanism (20, 36) is mechanically coupled to the closure mechanism (2) and thus an actuation of the closure mechanism is not possible, if the locking means (11) is disposed in the locking position. The locking means (11) can be moved into an unlocked position with the aid of an adjustment mechanism (10, 50), wherein a support mechanism (15, 16) retains the locking means (11) in the region of the unlocked position and releases an actuation of the closure mechanism of the door (2).

31 Claims, 7 Drawing Sheets

DOOR MOUNTING

BACKGROUND OF THE INVENTION

1. Field of the Invention

The present invention relates to a door mounting for a closure mechanism of a door. In particular, the present invention relates to an electric door mounting to be built onto entrance doors with closure systems, which are locked and unlocked for example with the aid of a profile cylinder lock.

2. Brief Description of the Background of the Invention Including Prior Art

It is already known to employ door mountings for bolting closure systems at entrance doors. In particular, various electrically locking door mountings are known to be built at entrance doors in this regard, which electrically locking door mountings lock and unlock the closure mechanism of the entrance door with the aid of an electromagnetic coupling, in order to prevent unauthorized access through the entrance door. It is however common to these known door mountings that both the electronic part as well as the mechanical part of the electrically locking and unlocking door mounting are constructed highly complicated and exhibit a multitude of details. Not only the production costs of the door mounting are high based on these features, but the door mounting can only be assembled and mounted with a relatively high expenditure.

A door mounting with the features of the preamble of claim 1 is known in this regard for example from the German printed patent document DE 35 37 785 A1. The door mounting includes a closure mechanism, wherein the closure mechanism can be unlocked based on a corresponding code entry with the aid of a card or of keypad. In case a corresponding adjustment signal is present, then an anchor is attracted and pulled with the aid of an electromagnet and of a permanent magnet against the spring force of compression spring, whereby an angle lever, resting at the spring rocker, is swivelled. The pressure point between the angle lever and the spring rocker is changed based on the swivelling of the angle lever, which leads to a shifting of a coupling sleeve against the force of a compression spring, such that the closure mechanism is unlocked. The latch of the door can be opened by rotating a door actuation knob, wherein in this case a corresponding voltage pulse is applied in the following to the electromagnet, such that the anchor is lifted, the angle lever is correspondingly swivelled by the spring rocker, and the coupling bush is moved again into the decoupled position. The closure mechanism is thereby again locked. Furthermore, this printed document proposes to monitor a lock actuation of the closure mechanism after the unlocking of the closure mechanism with the aid of a time control, such that after termination of a certain time interval the electromagnet is activated analogous to the previously described procedure in order to lock the closure mechanism. It can be recognized from the above description that this door mounting or, respectively, its closure mechanism again are constructed in a relatively complicated way.

SUMMARY OF THE INVENTION

1. Purposes of the Invention

It is a therefore an object of the present invention to provide a door mounting for a closure mechanism of a door which exhibits a clearly simplified construction with a lesser number of individual parts, such that the production costs are lowered and the mounting of the door mounting can be simplified.

It is another object of the present invention to provide a controlled door locking mechanism which provides for defined time intervals during which an opening of the door can be effected from the outside.

These and other objects and advantages of the present invention will be come evident from the description which follows.

2. Brief Description of the Invention

The present invention provides for a lock control system for a closure mechanism of a door. A locking means is adapted to move between an unlocked position and a locking position. A locking mechanism engages the locking means and is capable of being mechanically coupled with a closure mechanism of a door. The locking mechanism blocks an actuation of the closure mechanism if the locking means is disposed in a locking position. An adjustment mechanism engages the locking means, capable of receiving adjustment signals. The adjustment mechanism allows a motion of the locking means into the unlocked position upon occurrence of an adjustment signal received by the adjustment mechanism. A support mechanism engages the locking means. The support mechanism maintains the locking means in the unlocked position after a motion of the locking means from the locking position into the unlocked position. The support mechanism is constructed such that the support mechanism maintains the locking means in the unlocked position after the occurrence of the adjustment signal even after a following non-occurrence of a second adjustment signal if the locking means was disposed in the locking position prior to the occurrence of the adjustment signal. The support mechanism is constructed such that the support mechanism releases the locking means after the occurrence of the adjustment signal even in case of the following nonoccurrence of the adjustment signal for a return motion into the locking position if the locking means was disposed in the unlocked position prior to the occurrence of the adjustment signal.

The adjustment mechanism can include an electromagnet arrangement which moves the locking means into the unlocked position upon application of a voltage to the electromagnet arrangement. The locking means can be movably supported in the electromagnet arrangement. The locking means can be moved into the electromagnet arrangement upon application of a voltage to the electromagnet arrangement.

An elastic means can engage the locking means for pretensioning the locking means relative to the locking position.

The locking means can be formed by a locking bolt. A projection can be furnished at an outer side of the locking bolt. A first groove can be furnished at the support mechanism. The support mechanism can transfer the projection of the locking bolt upon occurrence of the adjustment signal into the first groove. A configuration of the projection disposed in the first grove can correspond to the unlocked position if the locking bolt was disposed in the locking position prior to the occurrence of the adjustment signal. A second groove can be furnished at the support mechanism. The support mechanism can transfer the projection of the locking bolt upon occurrence of the adjustment signal into the second groove. The configuration of the projection disposed in the second groove can correspond to the locking position if the locking bolt was disposed in the unlocked position prior to the occurrence of the adjustment signal. An additional first groove can be furnished at the support mechanism. An additional second groove furnished at the support mechanism.

A second projection can be disposed at the outer side of the locking bolt. The second projection can be disposed opposite to the first projection at the outer side of the locking bolt. Each first groove formed at the support mechanism can have a first depth, and each second groove formed at the support mechanism can have a second depth, where the second depth is less than the first depth. The first grooves and the second grooves can be distributed uniformly and alternatingly in circumference of the locking bolt. The first grooves and the second grooves can delimit an opening surrounding the locking bolt. The locking bolt can be led through said opening.

Each first groove can be connected to a neighboring second groove through a rising flank and through a falling flank of the support mechanism such that the rising flanks and falling flanks, connecting the individual first grooves to the individual second grooves, form a crown-shaped extending edge of the support mechanism. A crown-shaped extending counter edge of the support mechanism can also be formed by alternatingly arranged rising flanks and falling flanks and can be furnished disposed opposite to the crown-shaped extending edge. The counter edge can serve as a stop for the first projection and for the second projection of the locking bolt upon occurrence of the adjustment signal. The rising flanks and the falling flanks of the counter edge are disposed such relative to the rising flanks and the falling flanks of the crown-shaped extending edge, connecting the first grooves and the second grooves, that the first projection and the second projection of the locking bolt can be transferred from the first groove and from the second groove, respectively, over one flank of the counter edge into one second groove and one first groove, respectively, upon occurrence of the adjustment signal and a following non-occurrence of the adjustment signal.

A third groove can be formed at the support mechanism and in each case between the rising flanks and the falling flanks of the counter edge.

The rising flanks, rising in a circumferential direction of the crown-shaped extending edge, of the crown-shaped extending edge, connecting the first grooves and the second grooves, can be furnished steeper as compared to the falling flanks of the crown-shaped extending edge.

The rising flanks and the falling flanks of the counter edge can be disposed staggered relative to the rising flanks and the falling flanks of the crown-shaped extending edge, connecting the first grooves and the second grooves, such that in each case one of the falling flanks and the rising flanks of the counter edge, respectively, is disposed opposite to one of the first grooves and the second grooves, respectively. The rising flanks and the falling flanks of the counter edge can be disposed such that the first projection and the second projection together with the locking bolt can be moved groove by groove in a circumferential direction of the locking bolt based on a sequence of adjustment signals.

A door mounting body can carry the support mechanism. A thickening of a defined shape can be disposed at an end of the locking bolt and disposed toward the locking position of the locking bolt. An open narrowing can be disposed at the door mounting body. The thickening of the locking bolt can pass in the open narrowing of the door mounting body when the locking bolt transfers from the locking position into the unlocked position. The open narrowing can exhibit such a form that the thickening of the locking bolt passes in the open narrowing only if the first projection and the second projection of the locking bolt are disposed in the second groove. In this case the thickening with the locking bolt can be aligned and guided relative to the open narrowing.

Preferably there is provided a rotary shaft for mechanically coupling the locking mechanism with the closure mechanism of the door. The locking mechanism can include a first rotary supported disk with a first opening. The rotary shaft can be shape-matchingly guidable through the first opening such that a torque is transferred between the rotary shaft and the first rotary supported disk for actuating the closure mechanism.

Recesses can be distributed uniformly along a circumference of the first rotary supported disk. The locking means can engage into the recesses and thereby block a rotation of the first rotary supported disk as well as of the rotary shaft coupled to the first rotary supported disk. A compression element can be springingly pretensioned relative to the first rotary supported disk and press against the first rotary supported disk in order to exert thereby a rotary resistance upon rotation of the first rotary supported disk. First troughs can be disposed on the first rotary supported disk and distributed uniformly along the circumference of the first rotary supported disk. The first troughs can be formed in a width direction of the first rotary supported disk next to the recesses. The first troughs can exhibit a form which is complementary to an outer form of the compression element.

The locking mechanism can be constructed such and coupled to the closure mechanism such that the locking mechanism blocks only an actuation of the closure mechanism from an outer side of the door through the locking means. The locking mechanism can allows an actuation of the closure mechanism from an inner side of the door.

A second rotary supported disk can form part of the locking mechanism. The second rotary supported disk can exhibit rounded corner sections, distributed along a circumference of the second rotary supported disk. Upon rotation of the second rotary supported disk, the corner sections can induce a motion of the locking means out of the locking position to such an extent that the locking means is moved out of the respective recess of the first rotary supported disk and permits a rotation of the first rotary supported disk.

Mechanical coupling means can be attached to the second rotary supported disk and to the first rotary supported disk and allow a relative motion with a specific rotation angle between the first rotary supported disk and the second rotary supported disk. A second opening can be disposed at the second rotary supported. The rotary shaft can be guided through the second opening. The first rotary supported disk can be disposed adjoining to the second rotary supported disk. A disk projection can be furnished at a side face of the first rotary supported disk disposed opposite to the second rotary supported disk. A disk recess can be formed in the second rotary supported disk. The disk projection can be shiftedly supported in the disk recess. The disk recess can extend in rotation direction of the second rotary supported disk and allow the relative motion between the first rotary supported disk and the second rotary supported disk.

A first actuating element can be mechanically coupled to the rotary shaft at an outer side of the door. A second actuating element can be mechanically coupled directly to the second rotary supported disk at an inner side of the door. Preferably, the rotary shaft is only rotatable through the first actuating element if the locking means is not disposed in the locking position, while initially the second rotary supported disk is rotated corresponding to a longitudinal dimension of the disk recess, formed in the second rotary supported disk, relative to the first rotary supported disk upon actuation of the second actuating element. As a result, one of the rounded corner sections of the second rotary supported disk can move the locking means, disposed in the locking position, out of the locking position. A rotary motion of the second rotary supported disk can be subsequently transferred to the first rotary supported disk and the rotary shaft. An end of the disk recess, formed in the second rotary supported disk, can contact and abut at the disk projection, formed at the first rotary supported disk.

The rotary shaft can exhibit a multi-edge outer shape corresponding to the first opening in an area of the first opening of the first rotary supported disk. The rotary shaft can exhibit a circular outer shape corresponding to the second opening of the second rotary supported disk in an area of the second opening of the second rotary supported disk.

A compression element can be springingly pretensioned relative to the second rotary supported disk and press against the second rotary supported disk in order to exert thereby a rotary resistance during rotation of the second rotary supported disk. The second rotary supported disk can exhibits several second troughs, distributed uniformly along the circumference of the second rotary supported disk. The second troughs can exhibit a form matching to the outer form of the compression element.

An evaluation circuit, connected to the adjustment mechanism, can be provided for evaluating an input of a user and for applying an adjustment signal to the adjustment mechanism upon meeting a certain defined access condition based on the input of the user in order to induce a motion of the locking means into the unlocked position. The evaluation circuit can apply a first adjustment signal at the adjustment mechanism upon fulfilling the certain defined access condition by the input of the user in order to induce the motion of the locking means into the unlocked position. The support mechanism can be constructed such that the support mechanism retains the locking means in the unlocked position up to an occurrence of a new adjustment signal. The evaluation circuit can apply a second adjustment signal to the adjustment mechanism after passage of a certain defined time span after application of the first adjustment signal. The support mechanism can be constructed such that the support mechanism releases the locking means for a return motion into the locking position based on a motion of the locking means into a direction to the unlocked position caused by the adjustment mechanism.

The door mounting according to the present invention includes essentially a locking means, which locking means is movable between an unlocked position and a locked position, a locking mechanism, which is to be coupled mechanically with the closure mechanism of the door and which blocks the closure mechanism, if the locking means is disposed in the locked position, an adjustment mechanism which allows a motion of the locking means into the unlocked position in the presence of an adjustment signal, as well as a support mechanism, where the support mechanism retains the locking means after a motion of the locking means into the unlocked position.

The support mechanism is in particular constructed such that the support mechanism retains the locking means in the unlocked position even if the adjustment signal, previously applied at the adjustment mechanism, is no longer present. When an adjustment signal is again applied to the adjustment mechanism, however, the support mechanism releases the locking means again, such that the locking means can return into the locked position. This means that the support mechanism alternatingly retains the locking means in the unlocked position or releases the locking means in the locked position for a return motion with each activation of the adjustment mechanism.

For this purpose, the support mechanism can exhibit two oppositely disposed crown-like edges, wherein the lower crown edge comprises alternatingly disposed first grooves and second grooves which are coordinated either to the locked position or to the unlocked position of the locking means. In particular, these first and second grooves have different depths. The locking means formed by a locking bolt is furnished on its outside preferably with several projections, which projections are transferred alternatingly into the first grooves or, respectively, into the second grooves by the support mechanism in case of each activation of the adjustment mechanism. The teeth, forming the edge disposed opposite to the edge of the first grooves and of the second grooves, are disposed such that upon each actuation of the adjustment mechanism, i.e. upon each pulling up of the locking bolt, the projections of the locking bolt are moved along at the teeth of the opposite edge in the circumferential direction of the locking bolt and are transferred into a corresponding neighboring first groove or, respectively, second groove, such that the locking bolt is rotated in circumferential direction with each actuation of the adjustment mechanism.

The locking means can be constructed in particular in the form of a locking bolt and the adjustment mechanism can be constructed in the form of an electromagnet arrangement, wherein the locking bolt is supported linearly movable in the coil of the electromagnet arrangement, and wherein the locking bolt is pulled into the coil, i.e. to the unlocked position, upon application of a voltage at the coil. The locking bolt is preferably spring elastically pretensioned to the locking position, such that the locking bolt automatically returns into the locking position upon release of the locking bolt by the support mechanism.

The adjustment mechanism can be connected to a control circuit, for example in the shape of a microprocessor component, which monitors and evaluates a key entry or keypad entry of a user at the outside of the corresponding door and applies an adjustment signal at the adjustment mechanism in case of determination of an access authorization, such that the locking means is moved from the locking position to the unlocked position, in order to allow an actuation of the closure mechanism. The control circuit can be controlled relative to time such that after certain specific opening time (for example between 10 seconds and 15 seconds) the adjustment mechanism is again activated in order to perform a return of the locking means into the locked position.

The locking mechanism can exhibit a first disk, which is furnished with recesses, wherein the locking bolt engages into the recesses in the locked position, such that the disk cannot be turned in this case. In this case, the disk is coupled to the closure mechanism of the door through a rotary shaft such that an actuation of the closure mechanism of the door is prevented upon blocking the disk with the locking bolt.

Advantageously, the locking mechanism is constructed such that an actuation of the closure mechanism is permitted from the inner side of the door. For this purpose, the locking mechanism comprises a second, rotary supported disk, which disk can also be placed on the rotary shaft of the previously recited disk, but which second rotary disk is not force-matchingly coupled with the previously recited disk. Rather, this second disk is placed into rotation directly from the inner side of the door by a corresponding actuating mechanism, for example furnished in the shape of a door knob or door handle. This second disk is furnished with rounded corner sections at its outside, which rounded corner sections are pressed against the locking bolt, disposed in the locking position, upon rotation of the disk based on the actuation of the inner door knob, in order to move the locking bolt somewhat out of the locked position. This relative motion of the locking bolt out of the locked position is in particular of such size that the locking bolt is also moved out of the recesses of the first recited disk, such that the first disk coupled with the closure mechanism of the door can be rotated subsequently. The second recited disk is mechanically coupled to the first recited disk such that a transfer of the torque from the second disk to the first disk and thus also a transfer of the torque to the closure mechanism of the door (over the rotary shaft) becomes possible after a certain specific relative motion of the second disk relative to the first disk.

The door mounting according to invention is constructed of a relatively small number of individual parts, which in addition can be easily assembled. The production costs for the door mounting according to the present invention are thereby reduced and the door mounting can be fastened in the most simple way and manner to any desired door.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF THE INVENTION AND PREFERRED EMBODIMENTS

Figure 1:
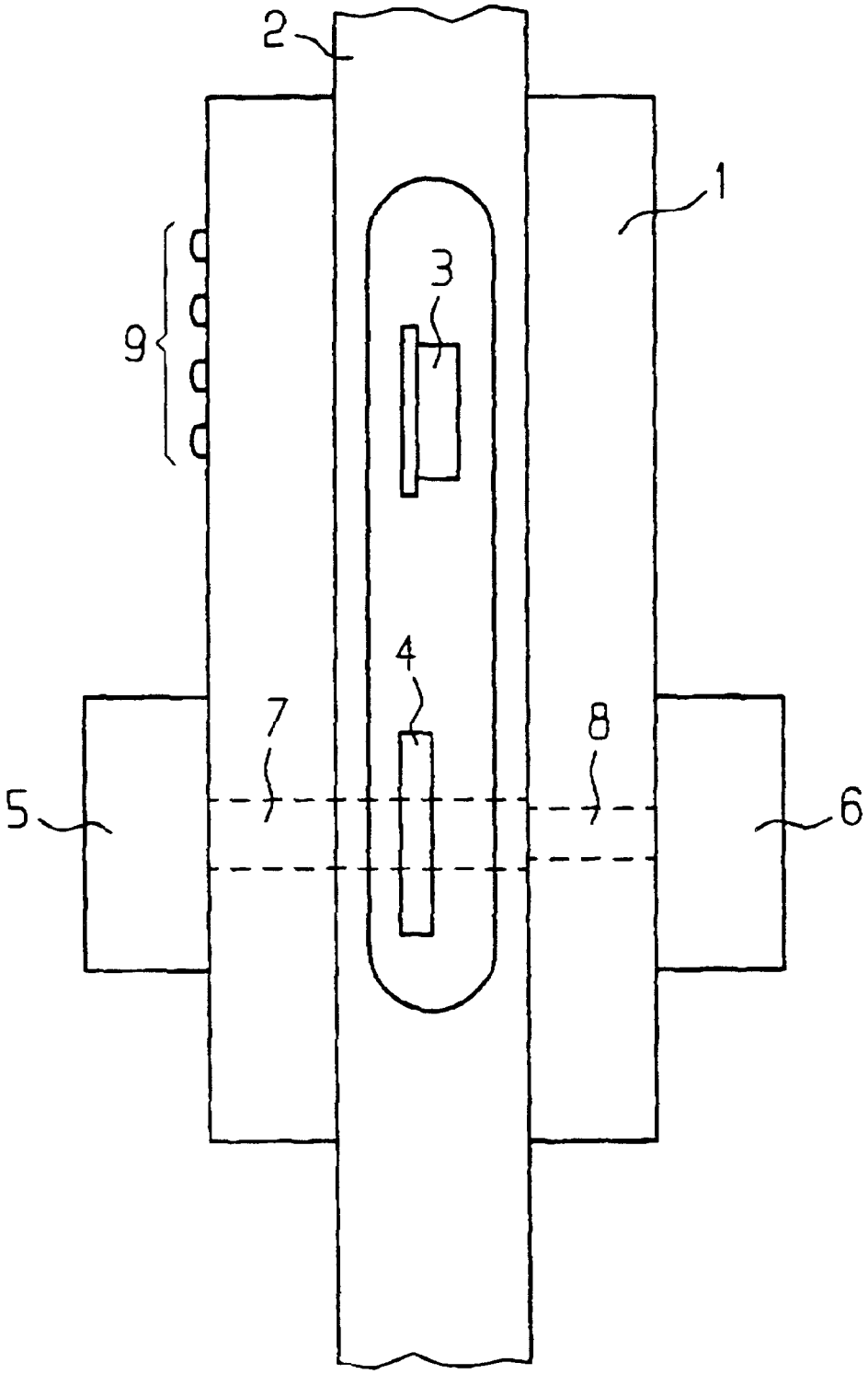
FIG. 1 shows a schematic side elevational view of a preferred embodiment of a door mounting according to the present invention.

FIG. 1 shows a schematically illustrated door mounting 1 according to the present invention, which door mounting 1 is attached at the inner side of a desired door 2, for example of an entrance door. A door mounting with a therein integrated keypad 9 for entry of a number code is also disposed at the outside of the door 2. The door 2 is furnished with a closure mechanism, formed for example as a dead lock, wherein the closure mechanism includes according to FIG. 1 a latch 3 and a bolt 4, and wherein the closure mechanism is locked and unlocked through an internal profile cylinder, not shown. The door mounting according to the present invention and shown in FIG. 1 is constructed such that the door mounting only permits an actuation of the closure mechanism from the outside of the door 2, if a correct number code is entered by a user into the keypad 9. In contrast, the door mounting 1 allows always an actuation of the closure mechanism for the inside of the door 2. An actuating mechanism is in each case furnished at the inside and at the outside of the door 2 for actuating the closure mechanism of the door 2. This actuating mechanism is illustrated in an exemplified way in FIG. 1 as an outer rotary knob 5 as well as an inner rotary knob 6. The rotary knob 5 is coupled with the closure mechanism, i.e. with the profile cylinder, of the door 2 through a first rotary supported shaft 7. This shaft 7 exhibits preferably a recess at the inner side of the door 2. A second shaft 8 passing through the door mounting 1 is force-matchingly and form-matchingly led into the recess, such that a rotation of the first shaft 7 and thus an actuation of the closure mechanism, i.e. of the profile cylinder, of the door 2 is only possible when the door mounting 1 also permits a rotation of the second shaft 8. As was illustrated before, the door mounting 1 is in particular constructed such that a rotation of the shaft 8 and thus also a rotation of the shaft 7 and an actuation of the closure mechanism of the door 2 's always possible with the inner rotary knob 6. Of course, the embodiment illustrated in more detail in the following of the door mounting 1 according to the present invention can also be modified such that also an actuation of the closure mechanism is only possible from the inside of the door 2 when a corresponding number code 9 or another access authorization has been entered by the user.

The profile cylinder of the closure mechanism of the door 2, not shown in FIG. 1, is for example constructed such that the bolt 4 is initially moved out into a first step based on a corresponding full rotation of the door knobs 5 or, respectively, 6, and the bolt 4 is transferred into its fully moved out position based on a further full rotation of the door knobs 5 or, respectively, 6. Correspondingly, full rotations of the door knobs 5 or, respectively, 6 in an opposite direction lead to a return motion of the bolt 4 into its half moved-out position or, respectively, its full moved-in position. If the door bolt 4 is already in its full moved-in position, then the latch 3 can be retracted into the opposite direction based on a rotation of the door knobs 5 or, respectively, 6.

The door mounting according to the present invention is to be illustrated in more detail in the following by making reference to the FIGS. 2 through 5. The FIGS. 2 through 5 show different states of the door mounting according to the present invention during assembly. In particular, the FIGS. 2 through 5 show in each case top planar views onto the door mounting according to the present invention, in case this door mounting 1 is demounted from the inner side of the door 2 illustrated in FIG. 1.

Figure 2:
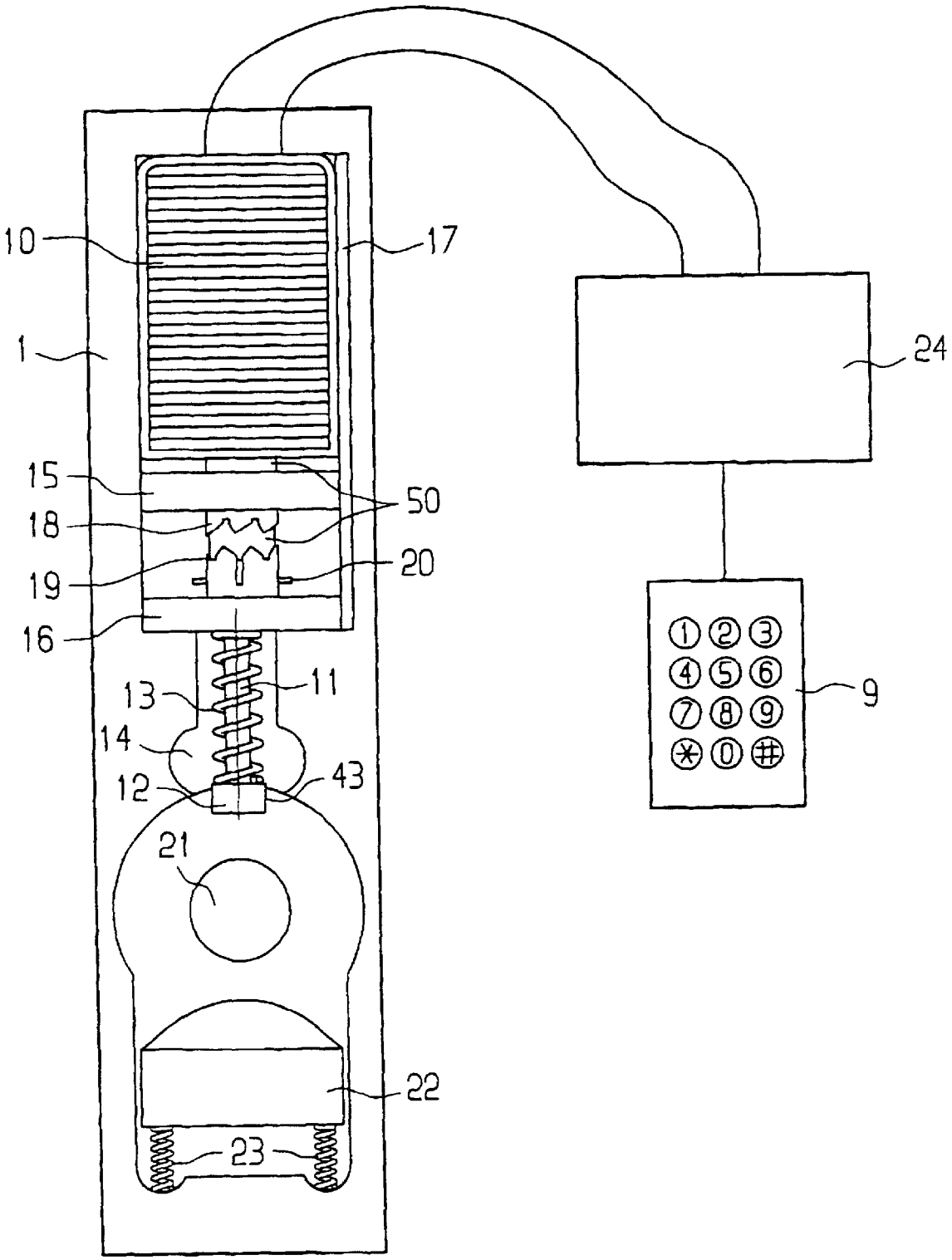
FIG. 2 shows a schematic view of a preferred embodiment of the door mounting according to the present invention for illustrating the construction of the door mounting according to the present invention.

As can be recognized from FIG. 2, the door mounting according to the present invention comprises for example a casing made of cast iron, wherein the individual parts of the door mounting according to the present invention are disposed in the inner spaces of the casing.

The door mounting 1 shown in FIG. 2 comprises a locking means in the form of a locking bolt 11, wherein the locking bolt 11 exhibits at its lower and an expansion 12 with a defined outer shape. The locking bolt 11 serves, as will be explained in more detail in the following, for blocking the closure mechanism of the door 2 shown in FIG. 1. For this purpose, the locking bolt 11 is movably supported between a locked position and an unlocked position. The locking bolt is shown in each case in its locked position in the FIGS. 2 through 5. The locking bolt 11 can be moved upwardly from its locked position into the unlocked position with an adjustment mechanism furnished also in the casing of the door mounting 1. The adjustment mechanism is furnished by an electromagnet arrangement in the present case, and a coil 10 and an anchor 50 of the electromagnet arrangement are illustrated in FIG. 2. The coil 10 and the anchor 50 form a so-called stroke magnet, wherein the locking bolt 11 is mechanically coupled with the anchor 50 or even formed as a single part with the anchor 50. If current flows in the coil 10, then the anchor 50 with the locking bolt 11 attached thereto is pulled into the coil body, wherein the locking mechanism of the door mounting 1 according to the present invention is unlocked in the pulled in position (unlocked position).

For example, the locking bolt 11 is pretensioned relative to the locking position through a spiral spring 13, such that, in case of no current is present in the coil body 10 under circumstances to be explained in more detail in the following, a return motion of the anchor 50 with the locking bolt 11 attached thereto is possible into the locking position illustrated in FIGS. 2 through 5. A larger recess is disposed in the casing of the door mounting 1 below the locking bolt 11, and the locking mechanism of the door mounting 1 is to be disposed in the larger recess, wherein the locking mechanism is either locked or unlocked with the aid of the locking bolt 11. A for example circular opening 21 is formed in this recess, wherein the opening 21 is open toward the inner side of the door shown in FIG. 1, such that the inner rotary knob 6, shown in FIG. 1, can be mechanically coupled with the bolting mechanism of the door mounting through this opening 21 as will be explained in more detail in the following.

The locking bolt 11 or, respectively, the anchor 50 are led through a support mechanism, which comprises essentially two parts 15 and 16 disposed opposite to each other. These two parts 15 and 16 together with the coil body 10 are attached, in particular screwed, to the casing of the door mounting 1, for example through an attachment plate 17, shown in FIG. 2. The support mechanism has the purpose according to the present invention to support the locking bolt in the unlocked position at least temporarily upon a motion of the locking bolt 11 into its unlocked position and to release the locking bolt 11 again later under certain conditions for a return motion into the locking position. For this purpose, the two parts 15 and 16 of the support mechanism exhibit edges 18 or, respectively, 19 disposed opposite to each other, wherein the two edges 18 and 19 have a crown-shaped course, and wherein the two edges 18 and 19 are formed by alternatingly disposed rising flanks and falling flanks. The support mechanism consisting of the two parts 15 and 16 provides with the aid of the crown-shaped, formed edges that the locking bolt 11 is alternatingly held in its unlocked position or transferred again into the locking position with each current passing through the coil body 10. The locking bolt 11 exhibits at least a projection 20 at its outer side. In order to improve the support of the locking bolt 11 in the lower part 16 of the support mechanism, the locking bolt is furnished however with several projections distributed uniformly over its circumference, in particular two oppositely disposed projections 20. These projections are transferred alternatingly into a higher disposed or into a lower disposed groove of the crown-shape formed edge 19 of the lower part 16 of the support mechanism with each electrical current passing through the coil body 10, wherein the projections 20 are guided from one groove to a neighboring groove over the counter edge 18 disposed above the edge 19, wherein the counter edge 18 also exhibits a crown-shaped course. The locking bolt 11 is held in its unlocked position 4*n* case the projections 20 of the locking bolt 11 are disposed in the higher located grooves of the edge 19, while the locking bolt 11 is disposed in its locking position in case the projections 20 are disposed in the lower located grooves of the edge 19. The function of the support mechanism is illustrated and explained in detail in the following with reference to FIG. 9.

The passing of the current through the coil body 10 is performed through an evaluation circuit or control circuit 24, which circuit can be formed in particular by a battery-operated microprocessor component, wherein the microprocessor component is preferably also disposed in the casing of the door mounting 1. The control circuit 24 monitors the keypad 9 shown also in FIG. 1, which keypad 9 is disposed on the outside of the door 2. However, a monitoring of a key insertion, of a magnetic card or the like is also possible instead of a keypad monitoring, such that the control circuit 24 can determine based on an entry of a user, if the user is authorized to actuate the closure mechanism of the door 2 shown in FIG. 1.

The control circuit 24 is disposed initially in a rest state. The control circuit 24 is switched into an operating state by actuating the key entry or the keypad entry at the outside of the door 2, and the control circuit 24 evaluates the key of the user or the entered code etc. The control circuit 24 recognizes by comparison with a preentered code, if the corresponding user is authorized to actuate the closure mechanism and is in possession of an access authorization. If no access authorization is recognized, then the control circuit 24 switches back into the previously mentioned waiting state, wherein the locking bolt 11 further remains in the locking position shown in FIGS. 2 through 5 and blocks an actuation of the locking mechanism at least from the outside of the door 2. If in contrast the control circuit 24 has recognized an access authorization, then an adjustment signal, formed as a voltage pulse, is applied at the electromagnet arrangement of the door mounting 1, whereby the locking bolt 11 is moved into its unlocked position and is maintained there initially by the support mechanism 15, 16. The support mechanism 15, 16 provides in particular that in this case the locking bolt 11 is also maintained in its unlocked position when in the meantime the coil 10 of the electromagnet is no longer subject go current or, respectively, the voltage pulse applied to the electromagnet arrangement has already disappeared again. The control circuit 24 is controlled by a timer and monitors the course of any desired presettable opening time, wherein the opening time can be for example between about 5 seconds and 30 seconds, and is preferably between about 10 seconds and 15 seconds. The control circuit 24 applies a renewed voltage pulse to the coil 10 after termination of this opening time, in order to furnish electrical current to the electromagnet arrangement. Based on this new voltage pulse, which corresponds to a renewed adjustment signal for the locking bolt 11, the locking bolt 11 is again released by the support mechanism 15, 16 and the locking bolt 11 can return again into its locking position based on the restoring spring force of the spiral spring 13, as it will be explained in the following in more detail with reference to FIG. 9. This return process is additionally supported by the weight force of the locking bolt 11, since the locking bolt 11 is disposed below the lower part 16 of the support mechanism. As soon as the locking bolt 11 has returned again into its locking position, the locking bolt 11 blocks again an actuation of the closure mechanism of the door 2 shown in FIG. 1 through the locking mechanism disposed in the lower recess of the casing of the door mounting 1.

In addition, the control circuit 24 monitors continuously the position of the locking bolt 11. The control circuit 24 continuously measures the inductivity of the coil 10 for reporting back the position of the locking bolt 11. The relative change of inductivity is here directly proportional to the ratio of the air distances in the pulled-in and in the moved-out state of the anchor 50, which anchor 50 is coupled to the locking bolt 11. With air distance is generally designated the distance between the position of the completely pulled-in anchor 50 and the actual position of the anchor 50. The coil 10 and the anchor 50 are advantageously constructed such that the ratio of the inductivity between the inductivity, occurring when the anchor is completely pulled-in, and the inductivity, occurring when the anchor is fully moved-out, is as large as possible and amounts to for example 10:1, such that the evaluation can be performed by the control circuit 24 with a relatively low electronic expenditure.

The cooperation of the electromagnet arrangement, on the one hand, and of the spring 13 operating as a restoring force can of course also be modified such that the locking bolt 11 is pressed permanently into a locked position upon current passing through the coil of the electromagnet with the aid of the electromagnet, while the current feed to the coil of the electromagnet is interrupted for the unlocking such that the spring 13 transfers the locking bolt into the unlocked position. The coil of the electromagnet would have to be subjected continuously to current in this modification for locking the closure mechanism of the door, which would result in a substantially higher use of electric current as compared to the arrangement shown in FIGS. 2 through 5.

After having described above in general the functioning of the invention door mounting according to a preferred embodiment, the construction of this door mounting is described in the following in more detail according to the preferred embodiment.

As was already previously illustrated and explained, the adjustment mechanism, formed by an electromagnet arrangement 10, 50, is disposed in the upper part of the door mounting 1 and the support mechanism, comprising the two parts 15, 16, is disposed below as was already previously explained. The anchor 50 of the electromagnet is disposed movably in the coil 10 and is coupled to the locking bolt 11, wherein on the one hand the anchor 50 is led through an opening, formed in the upper part 15 of the support mechanism, and on the other hand the locking bolt 11 is led through an opening, formed in the lower part 16 of the support mechanism.

As has been explained and illustrated before, the locking bolt 11 locks a locking mechanism disposed in the lower recess of the casing of the door mounting 1 in its locking position, wherein the locking mechanism is to be explained in detail in the following.

Figure 6:
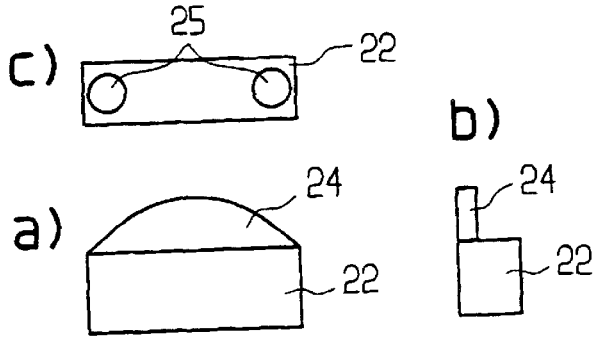
FIG. 6*a* shows a detailed front view of a pressure element illustrated in FIGS. 2 to 5.
FIG. 6*b* shows a detailed side view of the pressure element illustrated in FIGS. 2 to 5.
FIG. 6*c* shows a detailed top planar view onto the pressure element illustrated in FIGS. 2 to 5.

A compression element 22, shown in FIG. 2 is initially placed in this recess for mounting the locking mechanism, which compression element 22 is pretensioned relative to the locking bolt 11 with the aid of two spiral springs 23, which are supported at the bottom side of the recess. Various views of this compression element 22 are shown in FIG. 6, wherein FIG. 6*a* shows a front view also shown in FIG. 2, FIG. 6*b* shows a side view, and FIG. 6*c* shows at top planar view onto this compression element 22. The individual views show that the compression element 22 is formed of a substantially cuboid-shaped base body and a curve-shaped section 24 formed at the cuboid-shaped base body, wherein the curve-shaped section 24 exhibits a lesser thickness than the base body. Two holes 25 are formed at the bottom side of the base body, wherein the two holes 25 serve for receiving the spiral springs 23 shown in FIG. 2. The compression element 22, shown in FIG. 6 is initially disposed in the receiver hollow space of the casing of the door mounting 1 with the curve-shaped section 24 directed downwardly, such that the compression element 22 comes to rest as is shown in FIG. 2.

Figure 3:
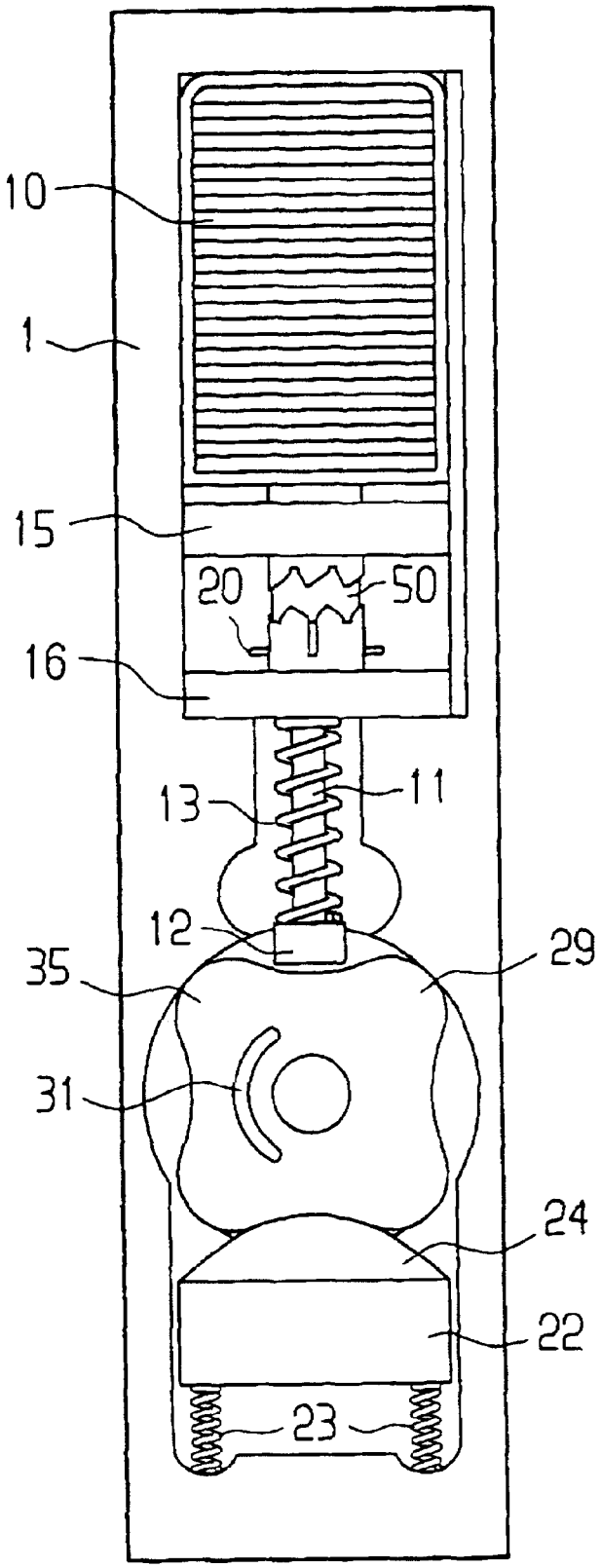
FIG. 3 shows a schematic view of a preferred embodiment of the door mounting according to the present invention for illustrating the construction of the door mounting according to the present invention.
Figure 7:
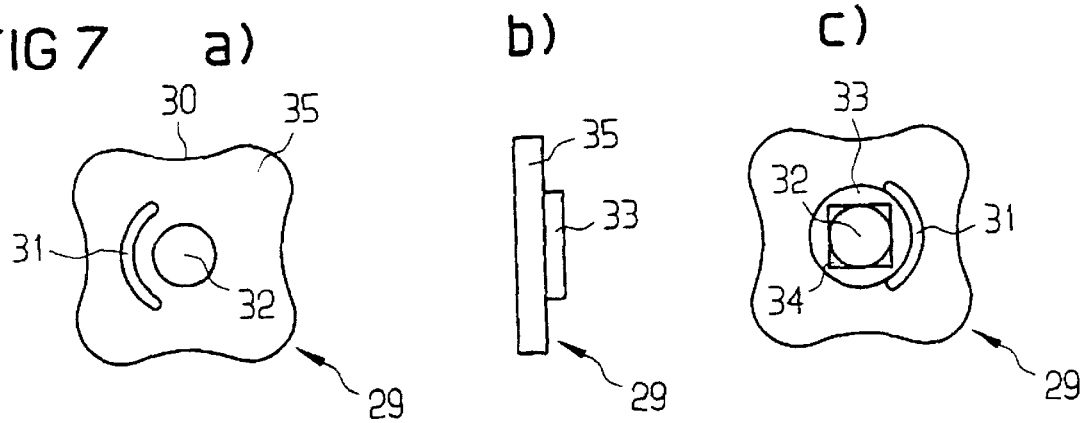
FIG. 7*a* shows a top planar view onto a rotary supported disk illustrated in FIG. 3.
FIG. 7*b* shows a side elevational view of the rotary supported disk illustrated in FIG. 3.
FIG. 7*c* shows a top planar view onto the rotary supported disk illustrated in FIG. 3.

In the following, a disk 29 is disposed in the previously recited hollow space of the casing as shown in FIG. 3. Various views of this disk 29 are shown in FIG. 7, wherein FIG. 7*a* shows a top planar view onto one side of this disk 29, FIG. 7*b* shows a side elevational view, and FIG. 7*c* a top planar view onto the opposite side of the disk 29. As can be gathered from the individual views, the disk 29 is furnished with several rounded corner sections 35, distributed uniformly along the circumference of the disk 29, such that the disk 29 exhibits a form similar to a clover leaf. A circular passage opening 32 is formed in the disk 29. Furthermore, the disk 29 possesses an elongated curve-shaped recess 31. As can be gathered from the side elevational view in FIG. 7*b* as well as in the top planar view of FIG. 7*c*, the disk 29 exhibits a preferably cylindrical-shaped projection 33 on the side face visible in FIG. 7*c*, wherein a square recess 34 is formed in the cylinder-shaped projection 33 following to the circular passage opening 32, wherein the side edges of this square recess 34 follow essentially to the side edges of the passage opening 32. Furthermore, it can be gathered from FIGS. 7*a* and 7*b* that troughs 30 are formed between the individual rounded corner sections 35 of the disk 29, wherein the outer shape of the troughs 30 corresponds to the shape of the curve-shaped section 24 of the compression element 22.

The disk shown in FIG. 7 is inserted into this opening 21 with the cylinder-shaped projection 33, where the diameter of the cylinder-shaped projection 33 essentially corresponds to the diameter of the opening 21, shown in FIG. 2, in the casing of the door mounting 1, such that the disk 29 becomes positioned as shown in FIG. 3. As can be recognized from FIG. 3, the thickening 12 of the locking bolt 11 is disposed between two rounded corner sections 35 of this disk 29 in the locking position. The diameter of the disk 29 is somewhat smaller than the diameter of the circular hollow space of the casing, wherein the opening 21 is formed in the center point of the circular hollow space of the casing, such that the disk 29, supported in the opening 21 with the aid of the projection 33 can be rotated in the corresponding hollow space. The ratio of the maximum diameter to the minimum diameter of the disk 29 can be from about 1.2 to 1.6 and is preferably from about 1.25 to 1.4. The compression element 22 has to be pressed down somewhat against the spring force of the springs 23 in order that the disk 29 can be inserted correctly into the hollow space of the door mounting casing, and such that after the insertion of the disk 29, the curve-shaped section 24 of the compression element 22 presses against one of the troughs 30 of the disk 29 based on the pretensioning force of the spring 23, and the curve-shaped section 24 exerts a slight resistance against the rotating of the disk 29 based on this compression force, wherein the curve-shaped section 24 always engages and latches in a next following trough 30 (FIG. 7*a*) of the disk 29 upon rotation of the disk 29 in order to define in this manner the predetermined rotary position of the disk 29.

As set forth above, the cylinder-shaped projection 33, shown in FIGS. 7*b* and 7*c*, is led through the opening 21 of the door mounting casing illustrated in FIG. 2. The inner door knob 6, illustrated in FIG. 1 can now also be inserted into the opening 21 from the outside of the door mounting casing and can be coupled there force matchingly to the disk 29. For this purpose, the door knob 6 can exhibit a square projection, where the outer shape of the square projection corresponds essentially to the square recess 34, illustrated in FIG. 7*c*, such that a rotation of the door knob 6 leads to a rotation of the disk 29.

Figure 4:
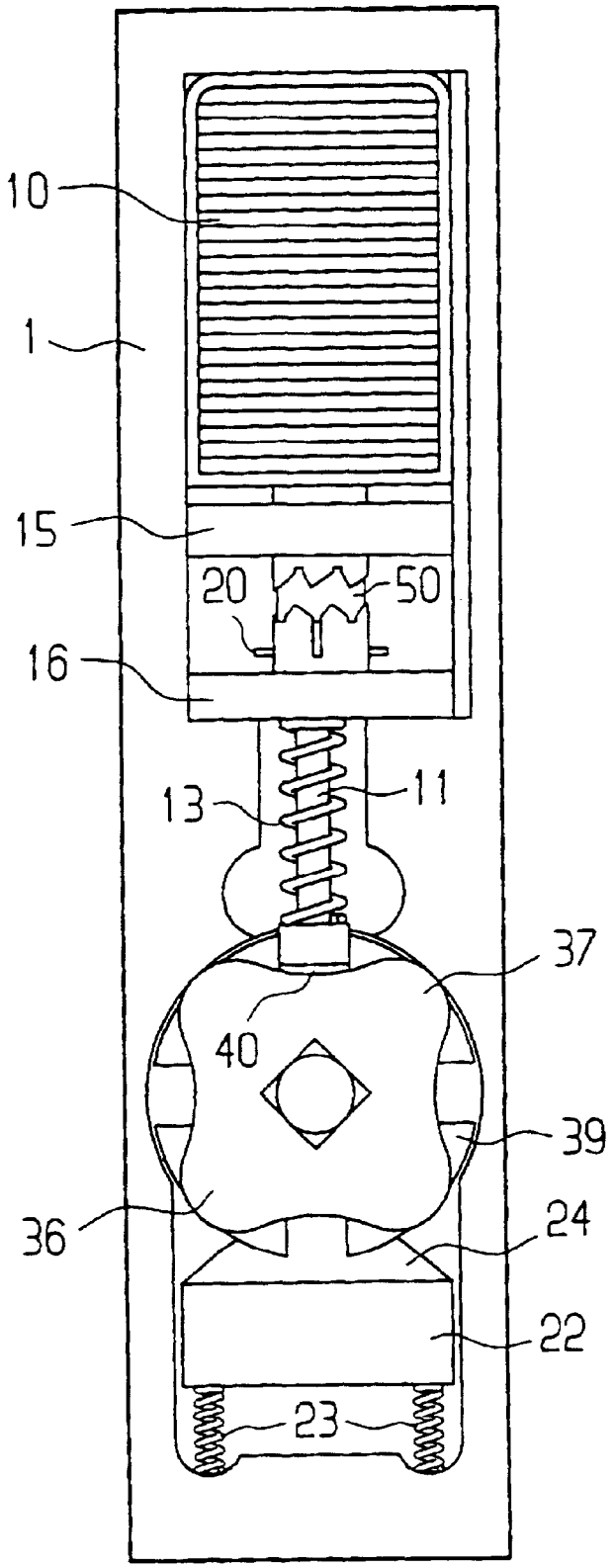
FIG. 4 shows a schematic view of a preferred embodiment of the door mounting according to the present invention for illustrating the construction of the door mounting according to the present invention.
Figure 8:
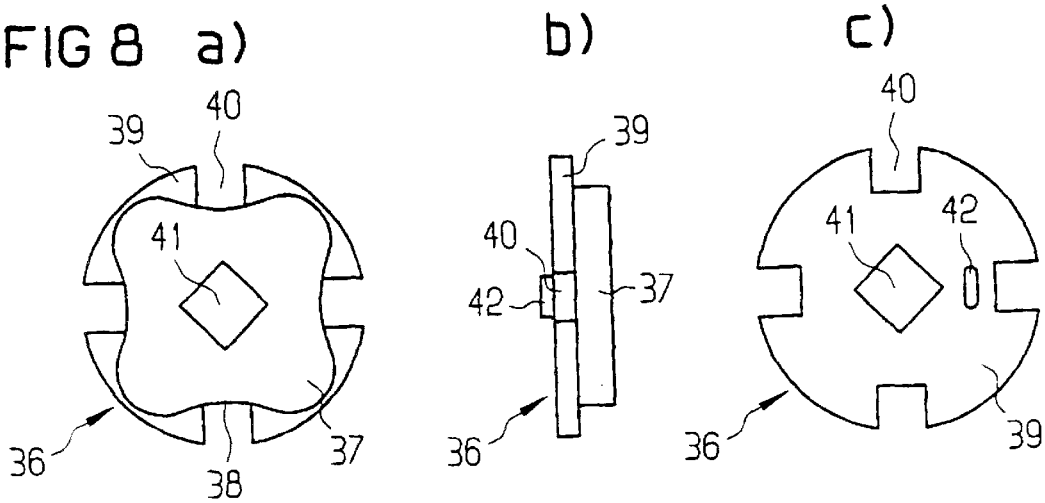
FIG. 8*a* shows a top planar view onto a second rotary supported disk illustrated in FIGS. 4 and 5, which disk forms together with the disk illustrated in FIG. 7 a locking mechanism of the door mounting according to the present invention.
FIG. 8*b* shows a side elevational view of the second rotary supported disk illustrated in FIGS. 4 and 5.
FIG. 8*c* shows a top planar view onto the second rotary supported disk illustrated in FIGS. 4 and 5.

In the following, a further disk 36 is placed on the already premounted disk 29, as shown in FIG. 4, wherein different views are illustrated in FIG. 8 corresponding to the views of this disk 36 shown in FIG. 7. FIG. 8*a* accordingly shows a top planar view corresponding to the view of FIG. 4 onto a side face of this disk 36, while FIG. 8*b* represents a side view, and FIG. 8*c* represents a top planar view onto the opposite side face of this disk 36. It can be gathered from FIG. 8*b* that this disk 36 is formed essentially of two layers. The upper layer is thereby formed by rounded corner sections 37, which are formed essentially analogous to the outer shape of the already premounted disk 29. The second layer forms projections 39, formed neighboring to the rounded corner sections 37, wherein the projections 39 exhibit in each case an inner form of the circular hollow space of the door mounting casing. The projections 39 are spaced apart from each other by recesses 40, wherein the width of these recesses corresponds at least to the width of the thickening 12 of the locking bolt 11. Thus, the locking bolt 11 extends over the narrowing 43 of the door mounting casing 1, the troughs 30 of the second disk 29, and the recess 40 in the first disk 36. The narrowing 43 serves to guide the locking bolt 11, while the engagement of the locking bolt 11 with the troughs 30 and the recess 40 serve to lock and unlock the door. A slightly elongated projection 42 is formed at the bottom side of the disk 36. Finally, a passage opening 41 is also formed in the disk 36, which passage opening 41 exhibits however a square shape.

The disk 36 is now placed on the previously assembled disk 29 as shown in FIG. 4, wherein the projection 42, formed at the bottom side of the disk 36, is led into the curve-shape formed recess 31 of the disk 29. This curve-shaped recess 31 makes possible a relative motion between the disk 29 and the disk 36, corresponding to the length of this recess, upon rotation of one of the two disks, before the projection 42 arrives at an end of the elongated recess 31 and thus the torque of the one disk is transferred to the other disk. It can be gathered from FIG. 4 that the locking bolt 11 protrudes into one of the recesses 40 of the disk 36 in the locking position such that the disk 36 cannot be rotated in this state. The passage opening 41 is preferably disposed rotated by 450 relative to the position of the square recess 34.

A further compression element 44 is placed according to FIG. 5 onto the arrangement shown in FIG. 4 in the following, which compression element 44 is formed analogously to the compression element 22 shown in FIG. 6. This compression element 44 therefore also possesses an essentially cuboid-shaped base body as well as a curve-shaped section 45 of a small width formed at the cuboid-shaped base body. This second compression element is inserted into the hollow space of the door mounting casing with the curve-shaped section 45 directed downwardly analogously to the first compression element 22. The second compression element 44 is also pretensioned relative to the locking bolt 11, for example, through spiral springs 46, wherein the spiral springs 46 are supported, on the one hand, at the casing of the door mounting 1 and, on the other hand, in openings formed at the bottom side of the compression element 44. For this reason, during the insertion of the compression element 44, the compression element 44 has to be pressed downwardly somewhat against the pretension force of the springs 46, such that the curve-shaped section 45 engages in one of the troughs 38 of the disk 36. Therefore, also the second compression element 44 serves as a resistance element for the rotation of the disk 36, wherein the curve-shaped section 45 engages always in one of the troughs 38 of the disk 36 upon rotation of the disk 36, wherein the troughs 38 of the disk 36 are formed analogously to the troughs 30 of the disk 29, and wherein the curve-shaped section 45 thus defines certain specific latch positions for the disk 36.

Figure 5:
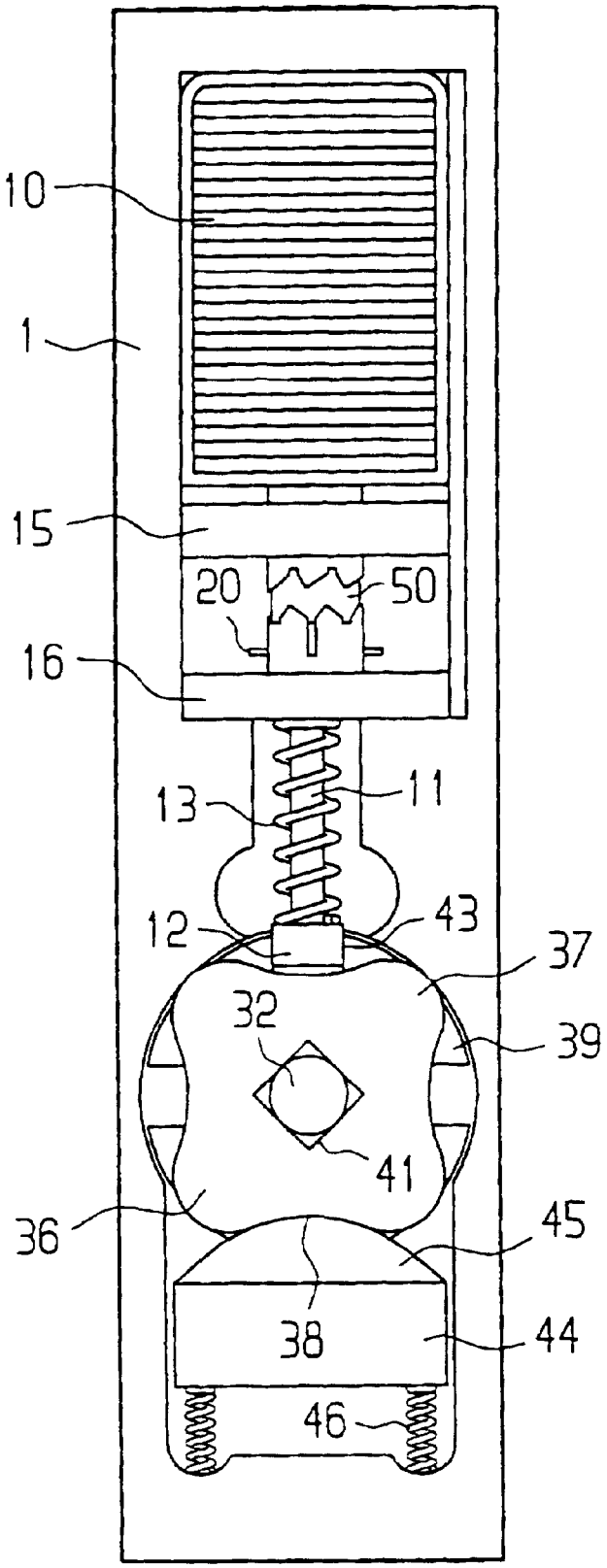
FIG. 5 shows a schematic view of a preferred embodiment of the door mounting according to the present invention for illustrating the construction of the door mounting according to the present invention.

The door mounting 1 is in principle finished with the construction shown in FIG. 5. The two disks 29 and 36 form the initially described locking mechanism of the door mounting according to the present invention.

Figure 10:
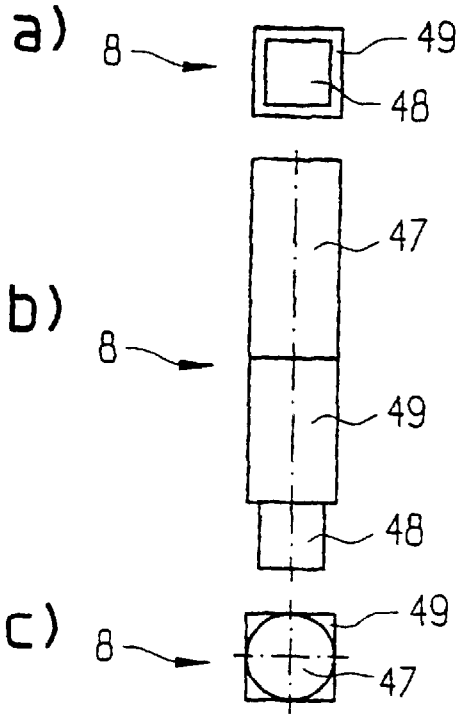
FIG. 10*a* shows a top planar view onto a rotary shaft, which rotary shaft is employed in the door mounting according to the present invention for transferring a torque to the closure mechanism of the door shown in FIG. 1.
FIG. 10*b* shows a longitudinal side view of the rotary shaft, which rotary shaft is employed in the door mounting according to the present invention for transferring a torque to the closure mechanism of the door shown in FIG. 1.
FIG. 10*c* shows a top planar view onto the rotary shaft, which rotary shaft is employed in the door mounting according to the present invention for transferring a torque to the closure mechanism of the door shown in FIG. 1.

This locking mechanism has to be still mechanically coupled to the closure mechanism of the door 2 for transferring the torque from the outer door knob 5, shown in FIG. 1 to the locking mechanism or, respectively, from the inner door knob 6, shown in FIG. 1 through the locking mechanism to the closure mechanism of the door 2. A rotary shaft can be employed for this purpose, wherein the rotary shaft is to be inserted into the openings 32 of the disk 29 and the opening 41 of the disk 36. Various views of this rotary shaft are shown in FIG. 10, wherein FIG. 10*b* shows a longitudinal side view, FIG. 10*a* shows a top planar view onto the end face of the rotary shaft disposed toward the door 2, and FIG. 10*c* a top planar view onto the end face of the rotary shaft 8 disposed toward the door knob 6. It can be gathered from the individual representations of FIG. 10 that the rotary shaft 8 is overall formed from three parts, wherein a square section 48 is formed initially at the end on the door side, and wherein a further square section 49 is formed adjoining thereto, wherein the further square section 49 exhibits are larger diameter than the first recited square section 48. An elongated section 47 with a circular cross-section follows to the further square section 49. This rotary shaft 8 is now guided with the section 47 first through the disk 36, shown in FIG. 5, and in the following through the disk 29, shown in FIG. 3, wherein the square section 49 of the rotary shaft 8 is disposed form-matchingly in the square recess 41 of the disk 36 and rests on the surface of the disk 29. The elongated section 47 with the circular cross-section is guided form-matchingly through the circular opening 32 of the disk 29 and protrudes advantageously at the end of the door mounting casing at the inner side of the door, such that the inner door knob 6, shown in FIG. 1, can be placed onto this elongated section 47. In this case, the inner door knob 6 runs loosely on the rotary shaft 8, i.e. a rotation of the inner door knob 6 is not transferred directly onto the rotary shaft 8. The inner door knob 6, however, is mechanically directly coupled to the disk 29 by exhibiting a square projection, wherein the square projection is formed complementary to the square recess 34 of the disk 29 and is inserted into the recess 34. Thus, a rotation of the inner door knob 6 effects simultaneously a rotation of the lower disk 29 of the door mounting. As it was already mentioned previously, a shaft 7 runs on the outer side of the door through the closure mechanism of the door 2 shown in FIG. 1, wherein the shaft 7 can be a part of the profile cylinder for actuating the closure mechanism, wherein a rotation of the outer door knob 5 is transferred directly onto this shaft 7. The shaft 7 exhibits a recess at the inner side of the door, wherein the recess is formed in particular complementary to the outer shape of the short square section 48 of the rotary shaft 8 of the door mounting according to the present invention, such that a torque transfer from the rotary shaft 8 to the rotary shaft 7 and inversely can occur by coupling this square section 48 with the further rotary shaft 7 of the closure mechanism.

The door mounting according to the invention functions now as follows.

The thickening 12, formed at the lower end of the locking bolt 11, is disposed in a recess 40 of the disk 36 in the locking position. Thus, a rotation of the disk 36 is not possible. It is now attempted in this state to actuate the closure mechanism of the door 2 with the outer door knob 5, shown in FIG. 1, from the outside of the door without unlocking the locking bolt 11, then a rotation of the shaft 7 and thus an actuation of the closure mechanism of the door 2 is blocked by the rotary shaft 8, supported form-matchingly in the square opening 41 of the disk 36, wherein the rotary shaft 8 is mechanically coupled at the inner side of the door 2 with the rotary shaft 7 on the outer side of the door 2. A rotation of the outer rotary door knob 5 as well of the rotary shaft 7 on the outer side of the door 2 with a following actuation of the closure mechanism is only possible if a rotation of the rotary shaft 8 of the door mounting 1 according to the present invention is not blocked by the disk 36. If, however, the locking bolt 11 is moved out of its locking position into the unlocked position, then the disk 36 can rotate unimpededly such that the closure mechanism can be activated from the outer side of the door.

The locking mechanism of the door mounting according to the present invention is now constructed such that for the case, when the locking bolt is disposed in the locking position, the closure mechanism of the door 2 can in fact not be actuated from the outer side of the door, but this is however possible with the inner rotary knob 6 from the inner side of the door. The reason for this is in the fact that, in contrast to the outer rotary knob 5, the inner rotary knob 6 is directly mechanically coupled with the disk 29, shown in FIG. 3 and 7, such that a rotation of the outer door knob 6 through the square recess 34 of the disk 29, illustrated in particular in FIG. 7*c*, is transferred to the disk 29. If the disk 29 is now rotated based on an actuation of the inner door knob 6, this allows the projection 42 of the disk 36 (compare FIG. 8*c*), disposed in the curve-shaped recess 31 of the disk 29, to perform a slight rotation of the disk 29 relative to the disk 36, disposed on top, before an end of the elongated recess 31 contacts and abuts at the projection 42 (FIG. 8*b* and FIG. 8*c*). This relative rotation allows that initially a corresponding one of the rounded corners sections 35 of the disk 29, illustrated in particular in FIG. 3, is rotated or, respectively, pressed against the lower end of the locking bolt 11 upon actuation of the inner door knob 6, such that the correspondingly rounded corner section of the disk 29 can move the locking bolt 11 somewhat upwardly against the spring force of the spring 13 and out of the locking position. The locking bolt 11 is thereby moved so far upwardly that the locking bolt 11 does no longer protrude into the recess 40 between two neighboring projections 39 of the upper disk 36. At this moment, the disk 36 is thus no longer blocked. A corresponding end of the recess 31 will contact and abut at the projection 42, formed at the lower side of the disk 36, at a certain point in time caused by the rotation of the lower disk 29 after moving the locking bolt 11 out of one of the recesses 40. Thus, the rotation of the disk 29 can be transferred onto the there above disposed disk 36 and the rotary shaft 8, shape-matchingly supported in the recess 41 (FIG. 5), by further rotating the inner rotary knob 6, shown in FIG. 1, through the recess 31 of the disk 29 and the projection 42 of the disk 36. The disk 36 is at this point in time no longer blocked, as was mentioned already, and thus the disk 36 can be rotated as desired by actuating the inner rotary knob 6, such that the rotation of the rotary shaft 8 can be transferred to the door-outer-side rotary shaft 7 of the closure mechanism of the door 2, as shown in FIG. 1, in order to actuate the closure mechanism.

If the lower disk 29 was rotated so far that one of the rounded corner sections 35 of the disk 29 has passed the locking bolt 11 and that now one of the troughs 30 (FIG. 7) of the disk 29 is disposed opposite to the locking bolt 11, then the locking bolt 11 can return again into the locking position shown in FIG. 5 such that the thickening 12 at the lower end of the locking bolt 11 engages again into a recess 40 (FIG. 4) of the upper disk 36 and thus can block the disk 36. However, the previously described process can be repeated by a renewed rotation of the inner rotary knob 6 illustrated in FIG. 1, such that again a relative rotation of the lower disk 29 is caused relative to the disk 36 disposed thereabove and a short-term unlocking of the locking bolt 11 is being caused in order to be able to subsequently rotate also the upper disk 36 and thus the rotary shaft 8 and to actuate the closure mechanism of the door through the mechanical dog follower mechanism, which dog follower mechanism is formed by the recess 31 of the lower disk 29 and the projection 42 of the upper disk 36.

Finally, it is pointed out that the projections of 39 of the upper disk 36, shown in particular in FIG. 8 as well as FIG. 4, are disposed between the circular sections 24 or, respectively, 45, disposed opposite to each other, of the two compression elements 22 or, respectively, 44 wherein these projections 39 can pass unimpededly between the two compression elements 22 and 44 upon rotation of the disk 36.

The unlocking process and the locking process are to be illustrated in the following in more detail with the aid of the support mechanism provided according to the present invention with reference to FIGS. 5 and 9.

As was already described previously, the support mechanism comprises essentially two parts 15 and 16, which are attached in the casing of the door mounting. The two parts in each case possess a tooth-like or, respectively, crown-like disposed edge 18 or, respectively, 19, which edge 18 or 19 delimits in each case a passage opening, formed in the upper part 15 or, respectively, in the lower part 16, for the anchor 50 or, respectively, for the locking bolt 11. The anchor 50 is thus led through the passage opening of the upper part 15, wherein the edge 18 of the part 15 extends in the circumferential direction of the anchor 50, while the locking bolt 11 is led through the passage opening of the lower part 16. The teeth of the lower edge 19 are formed by an alternating arrangement of rising and falling flanks, wherein the rising flanks in overcoming the same height difference run in each case steeper than the falling flanks according to the present embodiment. The rising flanks can have a rise angle of from about 50° to 70° and preferably from about 55° to 66° relative to a horizontal tangential line. The falling flanks can have a slope angle of from about 20° to 40° and preferably from about 25° to 35° relative to a horizontal tangential line.

Figure 9:
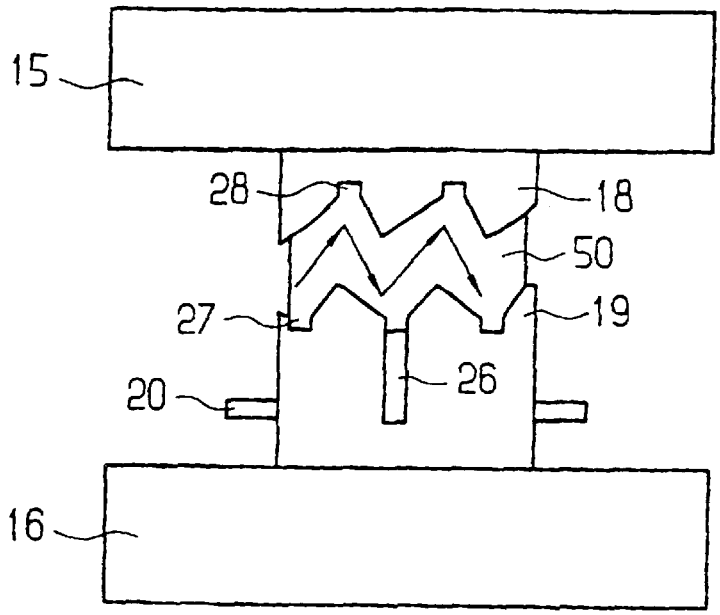
FIG. 9 shows an enlarged schematic view of a support mechanism of the invention door mounting illustrated in FIGS. 2 to 5.

Recesses are formed in the lower edge 19 between the individual teeth, wherein deep recesses or, respectively, grooves 26, and less deep grooves 27 are alternatingly formed as can be gathered from FIG. 9 in particular. The depth of the grooves 26 can be from about 1 to 3 times the height of the toothlike edge from bottom to top and is preferably 1.5 to 2.5 times the height of the toothlike edge from bottom to top. The less deep grooves can have a depth of from about 0.2 to 0.5 times the height of the toothlike edge from bottom to top. The widths of the grooves can be from about 0.1 to 0.2 times the radius of the toothlike edge 18. The individual grooves 26 or, respectively, 27 are distributed uniformly along the circumference of the edge 19, wherein preferably overall in each case four grooves 26 and four grooves 27 are disposed alternatingly in circumferential direction of the edge 19. The grooves 26 and 27 serve as a resting place of the already previously recited projections 20, which are formed at the outer side of the locking bolt 11. Preferably, the locking bolt 11 exhibits two oppositely disposed pin-like projections 20. If the projections 20 are disposed in oppositely located deeper grooves 26, then this corresponds to the locking position of the locking bolt 11. However, if the projections 20 are disposed in oppositely located less deep grooves 27, then the locking bolt has moved out of its locking position into an unlocked position.

The individual teeth of the counter edge 18 are disposed above the edge 19 and staggered relative to the teeth of the edge 19. Grooves 28 can also be formed between the individual teeth of the counter edge 18, wherein these grooves 28 serve as a stop face for the projections 20 of the locking bolt 11.

The projections 20 of the locking bolt 11 are disposed in oppositely located deep grooves 26 according to FIG. 9. If a voltage pulse is now applied at the electromagnet or, respectively, at the coil 10 for unlocking of the locking bolt 11, then the anchor 50 with the locking bolt 11 coupled thereto is pulled upwardly such that the projections 20 contact at and abut to the falling flank of the counter edge 18, disposed and protruding opposite to a corresponding groove 26 (as seen from the part 16). In the following, the projections 20 are led along this falling flank of the counter edge 18 such that the projections 20 according to FIG. 9 are transported to the right into a neighboring grooves 28 of the counter edge 18 relative to the corresponding groove 26. The corresponding projection 20 remains retained in this groove 28 even when current should be continued to be fed to the coil 10. However, as soon as the feed of current to the coil 10 is interrupted, i.e. the voltage pulse applied at the coil 10 has disappeared, then the anchor 50 with the locking bolt 11 coupled thereto is released by the coil 10 and pressed downwardly by the spiral spring 13, shown in FIG. 5, such that the projections 20 contact at and abut to a falling flank of the lower edge 19 and are led into a neighboringly disposed groove 27 relative to the corresponding groove 28 of the counter edge 18 along this falling flank based on the weight force of the locking bolt 11 as well as in particular the restoring force of the spring 13. The projections 20 now remain resting in this groove 27 for such time until a new voltage pulse is applied at the coil 10, which voltage pulse causes a pulling upward of the anchor 50 and of the locking bolt 11 with the projections 20 attached thereto, wherein the previously described procedure is repeated, however with the exception that now the projections 20 are led from a less deep recess 27 again into a deeper recess 26 after disappearance of the voltage pulse.

Overall there results thus the zig-zag-like course of the projections 20, shown in FIG. 9 based on the alternating application of a voltage pulse at the coil 10 of the electromagnet arrangement, wherein the projections 20 upon application of a voltage pulse are transported initially from a deep groove 26 into a less deep groove 27, disposed neighboring in a counter clockwise direction, and remain there for such time until a new voltage pulse is applied, which voltage pulse transfers the projections 20 from the corresponding group 27 again into a deep groove 26. In this manner the locking bolt 11 is transferred alternatingly into its locking position and its unlocked position upon application of voltage pulses to the electromagnet arrangement. A rotation of the locking bolt 11 in a counter clockwise direction is simultaneously connected therewith. If the teeth of the edge 18 are disposed such that a rising flank of the counter edge 18, as seen from the part 15, is disposed above the individual grooves 26 and 27, then the projections 20 with the locking bolt 11 migrate in clockwise direction through the individual grooves 26 and 27 of the lower edge 19 upon alternating application of voltage pulses at the electromagnet arrangement.

The projections 20 are resting in the deep groove 26 in the locking position, such that the locking bolt 11 is held thereby simultaneously. It has been mentioned previously that the locking bolt 11 exhibits a thickening 12 at its lower side, wherein the thickening 12 is a led in a narrowing 43 of the door mounting casing in the locking position of the locking bolt 11, as is shown in FIG. 5. This thickening 12 is thereby formed such that the thickening 12 can only pass the narrowing 43 if the projections 20 are disposed in the deep grooves 26, because only in this case the thickening 12 with the locking bolt 11 is rotated aligned relative to the narrowing 43 of the casing. If however the projections 20 are disposed in the less deep grooves 27, this is tantamount to the fact that the thickening 12 of the locking bolt 11 is rotated non-aligned relative to the narrowing 43 and thus cannot pass the narrowing 43 and rests at the upper edge of the narrowing 43. Of course, the height of the grooves 27 can be measured such that the locking bolt 11 is held solely through the projections 20 in the grooves 27 in the unlocked position, without resting with its thickening 12 at the upper edge of the narrowing 43.

The previously described support mechanism with the crown-like parts 15 and 16 performs thus the function that the locking bolt remains retained in the corresponding grooves 27 in the unlocked position even after a following non-occurrence of the adjustment signal, delivered by the control circuit 24 shown in FIG. 2, after moving the locking bolt 11 from its locking position into the unlocked position. The locking bolt 11 is transferred again into the locking position only upon occurrence of a renewed adjustment signal by the control circuit 24 or, respectively, upon application of a new voltage pulse at the coil 10 of the electromagnet arrangement. A relatively simple support mechanism for the locking bolt 11 is furnished in this manner in order to release in a time-controlled way the locking mechanism of the door mounting according to the present invention for a certain specific opening time with the aid of the control circuit 24. The control circuit 24 applies a first voltage pulse at the coil 10 of the electromagnet arrangement for this purpose after recognition of an access authorization of a user, whereby the locking bolt 11 is transferred from the locking position, shown in FIG. 5, into the unlocked position, and the projections 20 are transferred into higher disposed grooves 27. The control circuit 24 applies a renewed voltage pulse at the coil 10 after passing of a predetermined opening time, whereby the projections 20 are transferred from the high grooves 27 into the deep grooves 26 based on the previously described support mechanism, and the lock ng bolt 11 transfers again into the locking position. The locking mechanism comprising the previously described disks 29 and 36 as well as the rotary shaft 8 is released only during the previously defined opening time, such that the closure mechanism of the door 2 can be actuated from the outer side of the door only during this opening time through the outer rotary knob 5, illustrated in FIG. 1.

It will be understood that each of the elements described above, or two or more together, may also find a useful application in other types of mountings differing from the types described above.

While the invention has been illustrated and described as embodied in the context of a door mounting for a closure mechanism of a door, it is not intended to be limited to the details shown, since the various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A lock control system for a closure mechanism of a door, comprising locking means adapted to move between an unlocked position and a locking position;

a locking mechanism engaging the locking means and capable of being mechanically coupled with a closure mechanism of a door, wherein the locking mechanism blocks an actuation of the closure mechanism, if the locking means is disposed in a locking position;

an adjustment mechanism engaging the locking means, capable of receiving adjustment signals and wherein the adjustment mechanism allows a motion of the locking means when positioned in a locking position into an unlocked position upon occurrence of an adjustment signal received by the adjustment mechanism and wherein the adjustment mechanism allows a motion of the locking means when positioned in the unlocking position into the unlocked position upon occurrence of an adjustment signal received by the adjustment mechanism;

a support mechanism engaging the locking means, wherein the support mechanism maintains the locking means in the unlocked position after a motion of the locking means from the locking position into the unlocked position as long as no further adjustment signal is received by the adjustment mechanism, and wherein the support mechanism maintains the locking means in the locked position after a motion of the locking means from the unlocked position into the locking position as long as no further adjustment signal is received by the adjustment mechanism;

wherein the locking means includes a locking bolt with at least one projection and a groove to be engaged by the projection, wherein the locking position corresponds to an engagement of the locking bolt with the groove and wherein the unlocked position corresponds to a disengagement of the locking bolt from the groove.

2. The lock control system according to claim 1, wherein the adjustment mechanism includes an electromagnet arrangement which moves the locking means into the unlocked position upon application of a voltage to the electromagnet arrangement, wherein the locking means is movably supported in the electromagnet arrangement, and wherein the locking means is moved into the electromagnet arrangement upon application of a voltage to the electromagnet arrangement.

3. The lock control system according to claim 1, further comprising an elastic means engaging the locking means for pretensioning the locking means relative to the locking position.

4. The lock control system according to claim 1, further comprising a rotary shaft for mechanically coupling the locking mechanism with the closure mechanism of the door, wherein the locking mechanism includes a first rotary supported disk with a first opening, wherein the rotary shaft is shape-matchingly guidable through the first opening such that a torque is transferred between the rotary shaft and the first rotary supported disk for actuating the closure mechanism.

5. The lock control system according to claim 1, wherein the locking mechanism is constructed such and is coupled to the closure mechanism such that the locking mechanism blocks only an actuation of the closure mechanism from an outer side of the door through the locking means, and wherein the locking mechanism allows an actuation of the closure mechanism from an inner side of the door.

6. The lock control system according to claim 1, further comprising an evaluation circuit connected to the adjustment mechanism and for evaluating an input of a user and for applying an adjustment signal to the adjustment mechanism upon meeting a certain defined access condition based on the input of the user in order to induce a motion of the locking means into the unlocked position, wherein the evaluation circuit applies a first adjustment signal at the adjustment mechanism upon fulfilling the certain defined access condition by the input of the user in order to induce the motion of the locking means into the unlocked position, wherein the support mechanism is constructed such that the support mechanism retains the locking means in the unlocked position up to an occurrence of a new adjustment signal, and wherein the evaluation circuit applies a second adjustment signal to the adjustment mechanism after passage of a certain defined time span after application of the first adjustment signal, wherein the support mechanism is constructed such that the support mechanism releases the locking means for a return motion into the locking position based on a motion of the locking means into a direction to the unlocked position caused by the adjustment mechanism.

7. A lock control system for a closure mechanism of a door comprising locking means adapted to move between an unlocked position and a locking position:

a locking mechanism engaging the locking means and capable of being mechanically coupled with a closure mechanism of a door, wherein the locking mechanism blocks an actuation of the closure mechanism if the locking means is disposed in a locking position;

an adjustment mechanism engaging the locking means, capable of receiving adjustment signals and wherein the adjustment mechanism allows a motion of the locking means into the unlocked position upon occurrence of an adjustment signal received by the adjustment mechanism;

a support mechanism engaging the locking means, wherein the support mechanism maintains the locking means in the unlocked position after a motion of the locking means from the locking position into the unlocked position, and wherein the support mechanism is constructed such that the support mechanism maintains the locking means in the unlocked position after the occurrence of the adjustment signal even after a following non-occurrence of a second adjustment signal if the locking means was disposed in the locking position prior to the occurrence of the adjustment signal, and wherein the support mechanism is constructed such that the support mechanism releases the locking means after the occurrence of the adjustment signal even in case of the following non-occurrence of the adjustment signal for a return motion into the locking position if the locking means was disposed in the unlocked position prior to the occurrence of the adjustment signal;

wherein the locking means is formed by a locking bolt;

a projection furnished at an outer side of the locking bolt;

a first groove furnished at the support mechanism, wherein the support mechanism transfers the projection of the locking bolt upon occurrence of the adjustment signal into the first groove, wherein a configuration of the projection disposed in the first groove corresponds to the unlocked position if the locking bolt was disposed in the locking position prior to the occurrence of the adjustment signal;

a second groove furnished at the support mechanism, wherein the support mechanism transfers the projection of the locking bolt upon occurrence of the adjustment signal into the second groove, and wherein the configuration of the projection disposed in the second groove corresponds to the locking position if the locking bolt was disposed in the unlocked position prior to the occurrence of the adjustment signal;

an additional first groove furnished at the support mechanism;

an additional second groove furnished at the support mechanism.

8. The lock control system according to claim 7, further comprising a second projection disposed at the outer side of the locking bolt, and wherein the second projection is disposed opposite to the first projection at the outer side of the locking bolt;

wherein each first groove formed at the support mechanism has a first depth, and wherein each second groove formed at the support mechanism has a second depth, wherein the second depth is less than the first depth, wherein the first grooves and the second grooves are distributed uniformly and alternatingly in circumference of the locking bolt, wherein the first grooves and the second grooves delimit an opening surrounding the locking bolt, and wherein the locking bolt is led through said opening.

9. The lock control system according to claim 8, wherein each first groove is connected to a neighboring second groove through a rising flank and through a falling flank of the support mechanism such that the rising flanks and falling flanks, connecting the individual first grooves to the individual second grooves, form a crown-shaped extending edge of the support mechanism, and wherein a crown-shaped extending counter edge of the support mechanism is also formed by alternatingly arranged rising flanks and falling flanks and is furnished disposed opposite to the crown-shaped extending edge, wherein the counter edge serves as a stop for the first projection and for the second projection of the locking bolt upon occurrence of the adjustment signal, wherein the rising flanks and the falling flanks of the counter edge are disposed such relative to the rising flanks and the falling flanks of the crown-shaped extending edge, connecting the first grooves and the second grooves, that the first projection and the second projection of the locking bolt are transferred from the first groove and from the second groove, respectively, over one flank of the counter edge into one second groove and one first groove, respectively, upon occurrence of the adjustment signal and a following non-occurrence of the adjustment signal.

10. The lock control system according to claim 9, further comprising a third groove formed at the support mechanism and formed in each case between the rising flanks and the falling flanks of the counter edge.

11. The lock control system according to claim 9, wherein the flanks, rising in a circumferential direction of the crown-shaped extending edge, of the crown-shaped extending edge, connecting the first grooves and the second grooves, are furnished steeper as compared to the falling flanks of the crown-shaped extending edge.

12. The lock control system according to claim 9, wherein The rising flanks and the falling flanks of the counter edge are disposed staggered relative to the rising flanks and the falling flanks of the crown-shaped extending edge, connecting the first grooves and the second grooves, such that in each case one of the falling flanks and the rising flanks of the counter edge, respectively, is disposed opposite to one of the first grooves and the second grooves, respectively, wherein the rising flanks and the falling flanks of the counter edge are disposed such that the first projection and the second projection together with the locking bolt are moved groove by groove in a circumferential direction of the locking bolt based on a sequence of adjustment signals.

13. The lock control system according to claim 12 further comprising a door mounting body carrying the support mechanism;

a thickening of a defined shape disposed at an end of the locking bolt and disposed toward the locking position of the locking bolt;

an open narrowing disposed at the door mounting body, wherein the thickening of the locking bolt passes in the open narrowing of the door mounting body when the locking bolt transfers from the locking position into the unlocked position, and wherein the open narrowing exhibits such a form that the thickening of the locking bolt passes in the open narrowing only if the first projection and the second projection of the locking bolt are disposed in the second groove, wherein in this case the thickening with the locking bolt is aligned and guided relative to the open narrowing.

14. A lock control system for a closure mechanism of a door, comprising locking means adapted to move between an unlocked position and a locking position;

a locking mechanism engaging the locking means and capable of being mechanically coupled with a closure mechanism of a door, wherein the locking mechanism blocks an actuation of the closure mechanism if the locking means is disposed in a locking position;

an adjustment mechanism engaging the locking means, capable of receiving adjustment signals and wherein the adjustment mechanism allows a motion of the locking means into the unlocked position upon occurrence of an adjustment signal received by the adjustment mechanism;

a support mechanism engaging the locking means, wherein the support mechanism maintains the locking means in the unlocked position after a motion of the locking means from the locking position into the unlocked position, and wherein the support mechanism is constructed such that the support mechanism maintains the locking means in the unlocked position after the occurrence of the adjustment signal even after a following non-occurrence of a second adjustment signal if the locking means was disposed in the locking position prior to the occurrence of the adjustment signal, and wherein the support mechanism is constructed such that the support mechanism releases the locking means after the occurrence of the adjustment signal even in case of the following non-occurrence of the adjustment signal for a return motion into the locking position if the locking means was disposed in the unlocked position prior to the occurrence of the adjustment signal, a rotary shaft for mechanically coupling the locking mechanism with the closure mechanism of the door, wherein the locking mechanism includes a first rotary supported disk with a first opening, wherein the rotary shaft is share-matching guidable through the first opening such that a torque is transferred between the rotary shaft and the first rotary supported disk for actuating the closure mechanism;

recesses distributed uniformly along a circumference of the first rotary supported disk, wherein the locking means engages into the recesses and thereby blocks a rotation of the first rotary supported disk as well as of the rotary shaft coupled to the first rotary supported disk;

a compression element springingly pretensioned relative to the first rotary supported disk and pressing against the first rotary supported disk in order to exert thereby a rotary resistance upon rotation of the first rotary supported disk;

first troughs disposed on the first rotary supported disk and uniformly distributed along the circumference of the first rotary supported disk, wherein the first troughs are formed in a width direction of the first rotary supported disk next to the recesses, and wherein the first troughs exhibit a form which is complementary to an outer form of the compression element.

15. The lock control system according to claim 14, further comprising a second rotary supported disk forming part of the locking mechanism, wherein the second rotary supported disk exhibits rounded corner sections, distributed along a circumference of the second rotary supported disk, wherein the corner sections induce a motion of the locking means out of the locking position upon rotation of the second rotary supported disk to such an extent that the locking means is moved out of the respective recess of the first rotary supported disk and permits a rotation of the first rotary supported disk.

16. The lock control system according to claim 15, further comprising mechanical coupling means attached to the second rotary supported disk and to the first rotary supported disk and allowing a relative motion with a specific rotation angle between the first rotary supported disk and the second rotary supported disk;

a second opening disposed at the second rotary supported disk, wherein the rotary shaft is guided through the second opening, wherein the first rotary supported disk is disposed adjoining to the second rotary supported disk;

a disk projection furnished at a side face of the first rotary supported disk disposed opposite to the second rotary supported disk;

a disk recess formed in the second rotary supported disk, wherein the disk projection is shiftedly supported in the disk recess, and wherein the disk recess extends in rotation direction of the second rotary supported disk and allows the relative motion between the first rotary supported disk and the second rotary supported disk.

17. The lock control system according to claim 16, further comprising a first actuating element mechanically coupled to the rotary shaft at an outer side of the door;

a second actuating element mechanically coupled directly to the second rotary supported disk at an inner side of the door, wherein the rotary shaft is only rotatable through the first actuating element if the locking means is not disposed in the locking position, while initially the second rotary supported disk is rotated corresponding to a longitudinal dimension of the disk recess, formed in the second rotary supported disk, relative to the first rotary supported disk upon actuation of the second actuating element, whereby one of the rounded corner sections of the second rotary supported disk moves the locking means, disposed in the locking position, out of the locking position, and wherein a rotary motion of the second rotary supported disk is subsequently transferred to the first rotary supported disk and the rotary shaft, and wherein an end of the disk recess, formed in the second rotary supported disk, contacts and abuts at the disk projection, formed at the first rotary supported disk.

18. The lock control system according to claim 17, wherein the rotary shaft exhibits a multi-edge outer shape corresponding to the first opening in an area of the first opening of the first rotary supported disk, and wherein the rotary shaft exhibits a circular outer shape corresponding to the second opening of the second rotary supported disk in an area of the second opening of the second rotary supported disk.

19. The lock control system according to claim 16, further comprising a compression element springingly pretensioned relative to the second rotary supported disk and pressing against the second rotary supported disk in order to exert thereby a rotary resistance during rotation of the second rotary supported disk, wherein the second rotary supported disk exhibits several second troughs, distributed uniformly along the circumference of the second rotary supported disk, wherein the second troughs exhibit a form matching to the outer form of the compression element.

20. A door mounting (1) for a closure mechanism of a door (2), comprising a locking means (11), which is moveable between an unlocked position and a locking position, a locking mechanism (29, 36), which locking mechanism is capable of being mechanically coupled with the closure mechanism of the door (2) and which blocks an actuation of the closure mechanism, if the locking means (11) is disposed in the locking position, an adjustment mechanism (10, 50), which adjustment mechanism allows a motion of the locking means (11) into the unlocked position upon occurrence of an adjustment signal, and a support mechanism (15, 16), which support mechanism maintains the locking means (11) in the unlocked position after a motion of the locking means (11) from the locking position into the unlocked position, wherein the support mechanism (15, 16) is constructed such that the support mechanism maintains the locking means (11) in the unlocked position after occurrence of the adjustment signal even after a following non-occurrence of the adjustment signal, if the locking means (11) was disposed in the locking position prior to occurrence of the adjustment signal, and wherein the support mechanism (15, 16) is constructed such that the support mechanism releases the locking means (11) after occurrence of the adjustment signal even in case of the following non-occurrence of the adjustment signal for a return motion into the locking position, in case the locking means (11) was disposed in the unlocked position prior to occurrence of the adjustment signal;

wherein the locking means includes a locking bolt with at least one projection and a groove to be engaged by the projection, wherein the locking position corresponds to an engagement of the locking bolt with the groove and wherein the unlocked position corresponds to a disengagement of the locking bolt from the groove.

21. The door mounting according to claim 20, wherein the adjustment mechanism (10, 50) includes an electromagnet arrangement, which moves the locking means (11) into the unlocked position upon application of a voltage to the electromagnet arrangement, and wherein the locking means (11) is movably supported in the electromagnet arrangement (10, 50) and wherein the locking means (11) is moved into the electromagnet arrangement upon application of a voltage to the electromagnet arrangement.

22. The door mounting according to claim 20, wherein the locking means (11) is pretensioned relative to the locking position by an elastic means (13).

23. The door mounting according to claim 20, wherein an evaluation circuit (24) evaluates an input of a user and applies an adjustment signal to the adjustment mechanism (10, 50) upon meeting a certain defined access condition based on an input of the user in order to induce a motion of the locking means (11) into the unlocked position, wherein the evaluation circuit (24) applies a first adjustment signal at the adjustment mechanism (10, 50) upon fulfilling the certain defined access condition by the input of the user in order to induce the motion of the locking means (11) into the unlocked position, wherein the support mechanism (15, 16) is constructed such that the support mechanism (15, 16) retains the locking means (11) in the unlocked position up to an occurrence of a-new adjustment signal, and wherein the evaluation circuit (24) applies a second adjustment signal to the adjustment mechanism (10,50) after passage of a certain defined time span after application of the first adjustment signal, wherein the support mechanism (15, 16) is constructed such that the support mechanism (15, 16) releases the locking means (11) for a return motion into the locking position based on the motion of the locking means (11) into a direction to the unlocked position caused by the adjustment mechanism (10, 50).

24. A door mounting (1) for a closure mechanism of a door (2), comprising a locking means (11), which is moveable between an unlocked position and a locking position, a locking mechanism (29, 36), which locking mechanism is capable of being mechanically coupled with the closure mechanism of the door (2) and which blocks an actuation of the closure mechanism, if the locking means (11) is disposed in the locking position, an adjustment mechanism (10, 50), which adjustment mechanism allows a motion of the locking means (11) into the unlocked position upon occurrence of an adjustment signal, and a support mechanism (15, 16), which support mechanism maintains the locking means (11) in the unlocked position after a motion of the locking means (11) from the locking position into the unlocked position, wherein the support mechanism (15, 16) is constructed such that the support mechanism maintains the locking means (11) in the unlocked position after occurrence of the adjustment signal even after a following non-occurrence of the adjustment signal, if the locking means (11) was disposed in the locking position prior to occurrence of the adjustment signal, and wherein the support mechanism (15, 16) is constructed such that the support mechanism releases the locking means (11) after occurrence of the adjustment signal even in case of the following non-occurrence of the adjustment signal for a return motion into the locking position, in case the locking means (11) was disposed in the unlocked position prior to occurrence of the adjustment signal;

wherein the locking means is formed by a locking bolt (11), wherein the locking bolt exhibits at least one projection (20) at an outer side of the locking bolt (11), wherein the support mechanism (15, 16) is constructed such that the support mechanism transfers the at least one projection (20) of the locking bolt (11) into a first groove (27), corresponding to the unlocked position, upon occurrence of an adjustment signal, if the locking bolt (11) was disposed in the locking position prior to occurrence of the adjustment signal, and wherein the support mechanism (15, 16) is constructed such that the support mechanism transfers the at least one projection (20) of the locking bolt (11) into a second groove (26), corresponding to the locking position, upon occurrence of an adjustment signal, if the locking bolt (11) was disposed in the unlocked position prior to occurrence of the adjustment signal, wherein the support mechanism (15, 16) exhibits several uniform first grooves (27) and second grooves (26), disposed alternatingly in circumferential direction of the locking bolt (11), wherein the grooves delimit an opening, wherein the locking bolt (11) is led through said opening, wherein the second grooves (26) possess a lesser depth as compared to the first grooves (27), and wherein the locking bolt (11) exhibits projections (20), disposed opposite to each other, at the outer side of the locking bolt (11);

wherein each first groove (27) is connected to a neighboring second groove (26) through a rising flank and through a falling flank such that the rising flanks and falling flanks, connecting the individual grooves (27, 26) form a crown-shaped extending edge (19), and wherein a crown-shaped extending counter edge (18), also formed by alternatingly arranged rising flanks and falling flanks, is furnished disposed opposite to the crown-shaped extending edge (19), wherein the counter edge (18) serves as a stop for the projections (20) of the locking bolt (11) upon occurrence of an adjustment signal, wherein the flanks of the counter edge (18) are disposed such relative to the flanks of the edge (19), connecting the first groove (27) and the second groove (26), that the projections (20) of the locking bolt (11) are transferred from the first groove or, respectively, from the second groove over a flank of the counter edge (18) into a second groove (26) or, respectively, a first groove (27) upon occurrence of an adjustment signal and a following non-occurrence of the adjustment signal.

25. The door mounting according to claim 24, wherein in each case a third groove (28) is formed between the rising flanks and the falling flanks of the counter edge (18).

26. The door mounting according to claim 24, wherein the flanks, rising in the circumferential direction of the edge (19), of the edge (19), connecting the first grooves (27) and the second grooves (26), are furnished steeper as compared to the falling flanks.

27. The door mounting according to claim 24, wherein the rising flanks and the falling flanks of the counter edge (18) are disposed staggered relative to the rising flanks and the falling flanks of the edge (19), connecting the first grooves (27) and the second grooves (26), such that in each case a falling flank or a rising flank of the counter edge (18) is disposed opposite to a first groove (27) or a second groove (26), wherein the rising flanks and the falling flanks of the counter edge (18) are disposed such that the projections (20) together with the locking bolt (11) are moved groove by groove (27, 26) in a circumferential direction of the locking bolt (11) based on a sequence of adjustment signals, wherein the locking bolt (11) exhibits a thickening (12) of a defined shape at the end of the locking bolt (11) disposed toward the locking position, wherein the thickening (12) of the locking bolt (11) passes a narrowing (43) of the door mounting body (1) when transferring from the locking position into the unlocked position, and wherein the narrowing (43) exhibits such a form that the thickening (12) of the locking bolt (11) can pass the narrowing (43) only if the projections (20) of the locking bolt (11) are disposed in the second groove (26), wherein in this case the thickening (43) with the locking bolt (11) is directed aligned relative to the narrowing (43).

28. A door mounting (1) for a closure mechanism of a door (2), comprising a locking means (11), which is moveable between an unlocked position and a locking position, a locking mechanism (29, 36) which locking mechanism is capable of being mechanically coupled with the closure mechanism of the door (2) and which blocks an actuation of the closure mechanism, if the locking means (11) is disposed in the locking position, an adjustment mechanism (10, 50), which adjustment mechanism allows a motion of the locking means (11) into the unlocked position upon occurrence of an adjustment signal, and a support mechanism (15, 16) which support mechanism maintains the locking means (11) in the unlocked position after a motion of the locking means (11) from the locking position into the unlocked position, wherein the support mechanism (15, 16) is constructed such that the support mechanism maintains the locking means (11) in the unlocked position after occurrence of the adjustment signal even after a following non-occurrence of the adjustment signal, if the locking means (11) was disposed in the locking position prior to occurrence of the adjustment signal, and wherein the support mechanism (15, 16) is constructed such that the support mechanism releases the locking means (11) after occurrence of the adjustment signal even in case of the following non-occurrence of the adjustment signal for a return motion into the locking position, in case the locking means (11) was disposed in the unlocked position prior to occurrence of the adjustment signal;

wherein the locking mechanism (29, 36) can be coupled mechanically with the closure mechanism of the door (2) through a rotary shaft (8), wherein the locking mechanism includes a first rotary supported disk (36) with an opening (41), wherein the rotary shaft (8) is to be led shape-matchingly through the opening (41), such that a torque can be transferred between the rotary shaft (8) and the first disk (36) for actuating the closure mechanism, wherein the first disk (36) exhibits recesses (40), distributed uniformly along the circumference of the first disk (36), wherein the locking means (11) engages into the recesses (40) and thereby blocks a rotation of the first disk (36) as well as of the rotary shaft (8) coupled thereto, and wherein a compression element (44) is springingly pretensioned relative to the first disk (36) and presses against this first disk (36), in order to exert thereby a rotary resistance upon rotation of the first disk (36), wherein the first disk (36) exhibits troughs (38), uniformly distributed along the circumference of the first disk (36), wherein the troughs (38) are formed in the width direction of the first disk (36) next to the recesses (40) for the locking means (11), and wherein the troughs (38) exhibit a form which is complementary to the outer form of the compression element (44), wherein the locking mechanism (29, 36) is constructed such and is coupled to the closure mechanism that the locking mechanism (29, 36) blocks only an actuation of the closure mechanism from an outer side of the door (2) through the locking means (11), and wherein the locking mechanism (29, 36) allows an actuation of the closure mechanism from an inner side of the door (2), wherein the locking mechanism includes a second rotary supported disk (29), which second rotary supported disk (29) exhibits rounded corner sections (35), distributed along the circumference of the disk (29), which corner sections (35) induce a motion of the locking means (11) out of the locking position upon rotation of the second disk (29) to such an extent that the locking means (11) is moved out of the corresponding recess (40) of the first disk (36) and a rotation of the first disk (36) becomes possible, wherein the second disk (29) is coupled mechanically to the first disk (36) such that a relative motion with the specific rotation angle is possible between the first disk (36) and the second disk (29), wherein the second disk (29) exhibits an opening (32), wherein the rotary shaft (8) is to be led through the opening (32), wherein the first disk (36) is disposed adjoining to the second disk (29), and wherein the first disk (36) exhibits a projection (42) at a side face disposed opposite to the second disk (29), wherein the projection (42) is shiftedly supported in a recess (31) formed in the second disk (29), wherein the recess (31) extends in rotation direction of the second disk (29) and allows the relative motion between the first disk (36) and the second disk (29).

29. The door mounting according to claim 28, wherein the rotary shaft (8) is mechanically coupled at the outer side of the door to a first actuating element (5), and wherein the second disk (29) is mechanically coupled at the inner side of the door directly to a second actuating element (6), wherein the rotary shaft (8) is only rotatable through the first actuation element (5) if the locking means (11) is not disposed in locking position, while initially the second disk (29) is rotated corresponding to the longitudinal dimension of the recess (31), formed in the second disk (29), relative to the first disk (36) upon actuation of the second actuating element (6), whereby one of the rounded corner sections (35) of the second disk (29) moves the locking means (11), disposed in the locking position, out of the locking position, and wherein the rotary motion of the second disk (29) is transferred in the following to the first disk (36) and the rotary shaft (8) an end of the recess (31), formed in the second disk (29), contacts and abuts at the projection (42), formed at the first disk (36).

30. The door mounting according to claim 29, wherein the rotary shaft (8) exhibits a multi-edge outer shape corresponding to the opening (41) in the area of the opening (41) of the first disk (36), and wherein the rotary shaft (8) exhibits a circular outer shape corresponding to the opening (32) of the second disk (29) in the area of the opening (32) of the second disk (29).

31. The door mounting according to claim 28, wherein a compression element (22) is springingly pretensioned relative to the second disk (29) and presses against the second disk (29), in order to exert thereby a rotary resistance during rotation of the second disk (29), wherein the second disk (29) exhibits several troughs (30), distributed uniformly along the circumference of the second disk (29), wherein the troughs (30) exhibit a form corresponding to the outer form of the compression element (22).

* * * * *